US010773138B2

(12) United States Patent
Epling et al.

(10) Patent No.: US 10,773,138 B2
(45) Date of Patent: Sep. 15, 2020

(54) BALL BAT INCLUDING A FIBER COMPOSITE BARREL HAVING AN ACCELERATED BREAK-IN FUSE REGION

(71) Applicant: Wilson Sporting Goods Co., Chicago, IL (US)

(72) Inventors: Sean S. Epling, Portland, OR (US); Ty B. Goodwin, Vancouver, WA (US); Brent R. Slater, Vancouver, WA (US); Mark A. Fritzke, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/677,841

(22) Filed: Aug. 15, 2017

(65) Prior Publication Data

US 2019/0054357 A1 Feb. 21, 2019

(51) Int. Cl.

| | |
|---|---|
| ***A63B 60/00*** | (2015.01) |
| ***A63B 59/50*** | (2015.01) |
| ***A63B 59/54*** | (2015.01) |
| *A63B 102/18* | (2015.01) |

(52) U.S. Cl.

CPC ..... *A63B 60/00* (2015.10); *A63B 59/50* (2015.10); *A63B 59/54* (2015.10); *A63B 2102/18* (2015.10); *A63B 2102/182* (2015.10); *A63B 2209/02* (2013.01)

(58) Field of Classification Search

CPC ..... A63B 59/51–54; A63B 59/56
USPC ..... 473/564–567
See application file for complete search history.

(56) References Cited

U.S. PATENT DOCUMENTS

| | | | | |
|---|---|---|---|---|
| 5,094,453 | A * | 3/1992 | Douglas | A63B 60/02 473/566 |
| 5,303,917 | A | 4/1994 | Uke | |
| 5,961,405 | A | 10/1999 | MacKay, Jr. | |
| 5,964,673 | A | 10/1999 | MacKay, Jr. | |
| 7,115,054 | B2 | 10/2006 | Giannetti et al. | |
| 7,163,475 | B2 | 1/2007 | Giannetti | |
| 7,361,107 | B2 | 4/2008 | Giannetti et al. | |
| 7,442,135 | B2 | 10/2008 | Giannetti et al. | |
| 7,527,570 | B2 | 5/2009 | Giannetti et al. | |
| 7,699,725 | B2 * | 4/2010 | McNamee | A63B 59/50 473/567 |
| 7,749,115 | B1 * | 7/2010 | Cruz | A63B 59/50 473/567 |
| 7,857,719 | B2 | 12/2010 | Giannetti et al. | |
| 7,896,763 | B2 | 3/2011 | Giannetti et al. | |
| 7,955,200 | B1 | 6/2011 | Cruz et al. | |

(Continued)

*Primary Examiner* — Laura Davison
(74) *Attorney, Agent, or Firm* — Terence P. O'Brien

(57) ABSTRACT

A ball bat extending about a longitudinal axis and configured for testing under an accelerated break-in test. The bat includes a barrel portion that includes an inner surface and is formed of a fiber composite material having wall thickness of at least 0.100 inch. The fiber composite material includes at least first and second plies. The first ply includes a first plurality of fibers aligned adjacent to one another and a first resin, and the second ply includes a second plurality of fibers aligned adjacent to one another and a second resin. The inner surface of the barrel portion defines at least one annular groove. The at least one annular groove creates an ABI fuse region of the barrel portion. The ABI fuse region forms a crack initiation location when the bat is subjected to the accelerated break-in test.

21 Claims, 18 Drawing Sheets

(56) References Cited

U.S. PATENT DOCUMENTS

| | | | | |
|---|---|---|---|---|
| 8,182,377 | B2 | 5/2012 | Chuang et al. | |
| 8,197,366 | B2 | 6/2012 | Chauvin et al. | |
| 8,206,250 | B1 | 6/2012 | Cruz et al. | |
| 8,298,102 | B2 | 10/2012 | Chauvin et al. | |
| 8,317,640 | B1 | 11/2012 | Cruz et al. | |
| 8,376,881 | B2 | 2/2013 | Chuang et al. | |
| 8,435,143 | B2 * | 5/2013 | Vander Pol | A63B 60/00 473/566 |
| 8,449,412 | B2 | 5/2013 | Vander Pol et al. | |
| 8,480,519 | B2 | 7/2013 | Chauvin et al. | |
| 8,506,429 | B2 | 8/2013 | Chauvin et al. | |
| 8,512,176 | B1 | 8/2013 | Mathew et al. | |
| 8,708,845 | B2 * | 4/2014 | Chuang | A63B 59/06 473/567 |
| 8,727,917 | B2 | 5/2014 | Vander Pol et al. | |
| 8,795,108 | B2 | 8/2014 | Chauvin et al. | |
| 8,852,037 | B2 * | 10/2014 | Epling | A63B 59/50 473/567 |
| 8,858,373 | B2 | 10/2014 | Epling et al. | |
| 8,979,682 | B2 * | 3/2015 | Chuang | A63B 59/70 473/566 |
| 8,992,352 | B1 | 3/2015 | Lindsay et al. | |
| 9,211,460 | B2 * | 12/2015 | Slater | A63B 59/50 |
| 9,238,163 | B2 | 1/2016 | Slater et al. | |
| 9,242,155 | B1 | 1/2016 | Lindsay et al. | |
| 2005/0070384 | A1 | 3/2005 | Fitzgerald et al. | |
| 2006/0025253 | A1 | 2/2006 | Giannetti et al. | |
| 2008/0070725 | A1 | 3/2008 | Davis | |
| 2012/0184402 | A1 * | 7/2012 | McNamee | A63B 59/50 473/520 |
| 2012/0231904 | A1 | 9/2012 | Fonte | |
| 2018/0250565 | A1 * | 9/2018 | Wiese | A63B 60/00 |

* cited by examiner

BALL BAT INCLUDING A FIBER COMPOSITE BARREL HAVING AN ACCELERATED BREAK-IN FUSE REGION

FIELD OF THE INVENTION

The present invention relates to a ball bat including a fiber composite barrel portion having an accelerated break-in (ABI) fuse region.

BACKGROUND OF THE INVENTION

Baseball and softball organizations periodically publish and update equipment standards and/or requirements including performance limitations for ball bats. One recently issued standard is the Bat-Ball Coefficient of Restitution ("BBCOR") Standard adopted by the National Collegiate Athletic Association ("NCAA") on May 21, 2009. The BBCOR Standard, which became effective on Jan. 1, 2011 for NCAA baseball, is a principal part of the NCAA's effort, using available scientific data, to maintain as nearly as possible wood-like baseball bat performance in non-wood baseball bats. Although wood ball bats provide many beneficial features, they are prone to failure, and because wooden ball bats are typically solid (not hollow), wooden bats can be too heavy for younger players even at reduced bat lengths. Wood ball bats also provide little or no flexibility in the design of the hitting or barrel region of the bat. Non-wood bats, such as bats formed of aluminum, other alloys, composite fiber materials, thermoplastic materials and combinations thereof, allow for performance of the bat to be more readily tuned or adjusted throughout or along the hitting or barrel portion. Such characteristics enable non-wood bats to provide more consistent performance, increased reliability and increased durability than wood bats.

Other organizations have also adopted the BBCOR Standard. For example, the National Federation of State High School Associations (NFHS) has set Jan. 1, 2012 as the effective date for implementation of the BBCOR Standard for high school play. The BBCOR Standard includes a 0.500 BBCOR bat performance limit, which specifies that no point on the barrel or hitting portion of a bat can exceed the 0.500 BBCOR bat performance limit.

Another recent example of new bat performance limitations is the new USA Baseball bat standard (USABat) which also includes accelerated break-in testing of composite ball bats to ensure that the bat's performance does not increase during or after undergoing a bat rolling procedure. Effective on Jan. 1, 2018, Little League Baseball® will adhere to the new USABat standard, and no bats previously approved for use in Little League play will be permitted to be used in any Little League game or practice, or other Little League event. Other organizations implementing the new USABat standard include PONY Baseball, Babe Ruth Baseball/Cal Ripken Baseball, Dixie Youth Baseball, American Amateur Baseball Congress and Amateur Athletic Union.

When fiber composite bat barrels are used in a bat design, many of the new equipment standards and/or requirements also require the bat to undergo an accelerated break-in test procedure wherein the bat is repeatedly rolled in a barrel rolling procedure and then performance tested until the bat fails or shows evidence of failing.

Accordingly, a need exists to develop a method and/or system for forming barrel portions of a ball bat or other cylindrical portions of a ball bat using fiber composite material that can satisfy ball bat equipment standards and/or requirements in a cost effective, reliable and high quality manner. What is needed is a system or process of developing a ball bat that provides a high quality cosmetic appearance, is highly durable, and provides the desired operational characteristics. It would be advantageous to provide a ball bat, and a system or method for producing a ball bat including a barrel portion formed of fiber composite material, that can satisfy performance requirements, such as BBCOR certification or the USABat standard, without adding too much weight or wall thickness to the barrel portion. It would be advantageous to provide a ball bat with a desirable level of barrel stiffness, and provides exceptional feel and performance.

SUMMARY OF THE INVENTION

The present invention provides a ball bat extending about a longitudinal axis and that is configured for testing under an accelerated break-in test. The bat includes a barrel portion including a proximal region and a distal region. The barrel portion is formed of a fiber composite material having wall thickness of at least 0.100 inch. The fiber composite material includes at least first and second plies. The first ply includes a first plurality of fibers aligned adjacent to one another and a first resin, and the second ply includes a second plurality of fibers aligned adjacent to one another and a second resin. The first ply includes a first fiber discontinuity and the second ply includes a second fiber discontinuity. The first and second fiber discontinuities are generally aligned with each other such that one of the first and second fiber discontinuities substantially overlies the other of the first and second fiber discontinuities creating an ABI fuse region of the barrel portion. The ABI fuse region forms a crack initiation location when the bat is subjected to the accelerated break-in test.

According to a principal aspect of a preferred form of the invention, a ball bat extending about a longitudinal axis and that is configured for testing under an accelerated break-in test. The bat includes a barrel portion that includes an inner surface and is formed of a fiber composite material having wall thickness of at least 0.100 inch. The fiber composite material includes at least first and second plies. The first ply includes a first plurality of fibers aligned adjacent to one another and a first resin, and the second ply includes a second plurality of fibers aligned adjacent to one another and a second resin. The inner surface of the barrel portion defines at least one annular groove. The at least one annular groove creates an ABI fuse region of the barrel portion. The ABI fuse region forms a crack initiation location when the bat is subjected to the accelerated break-in test.

This invention will become more fully understood from the following detailed description, taken in conjunction with the accompanying drawings described herein below, and wherein like reference numerals refer to like parts.

DETAILED DESCRIPTION OF THE INVENTION

Figure 1:
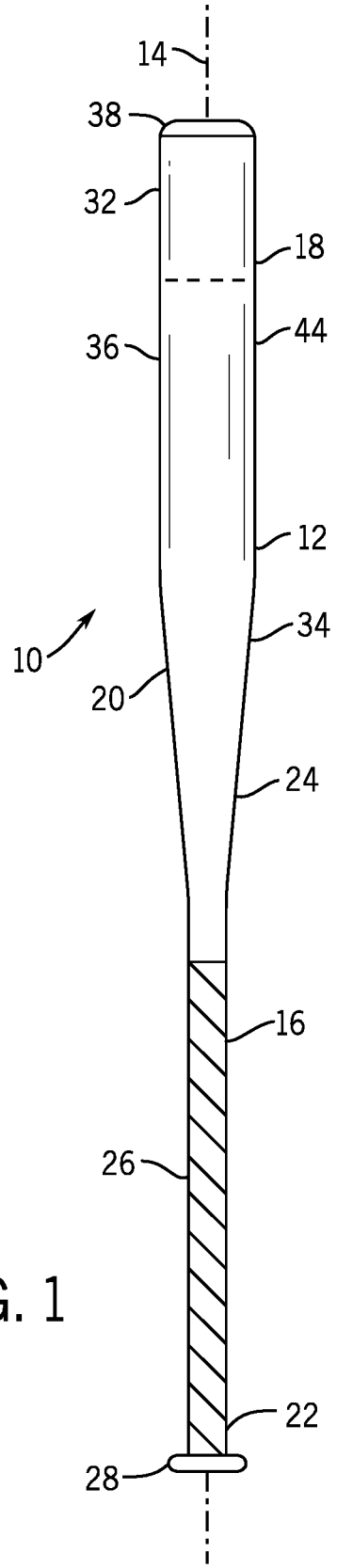
FIG. 1 is a side view of a ball bat in accordance with one implementation of the present invention.

Referring to FIG. 1, a ball bat is generally indicated at 10. The ball bat 10 of FIG. 1 is configured as a baseball bat; however, the invention can also be formed as a slow pitch softball bat, a fastpitch softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

Figure 8:
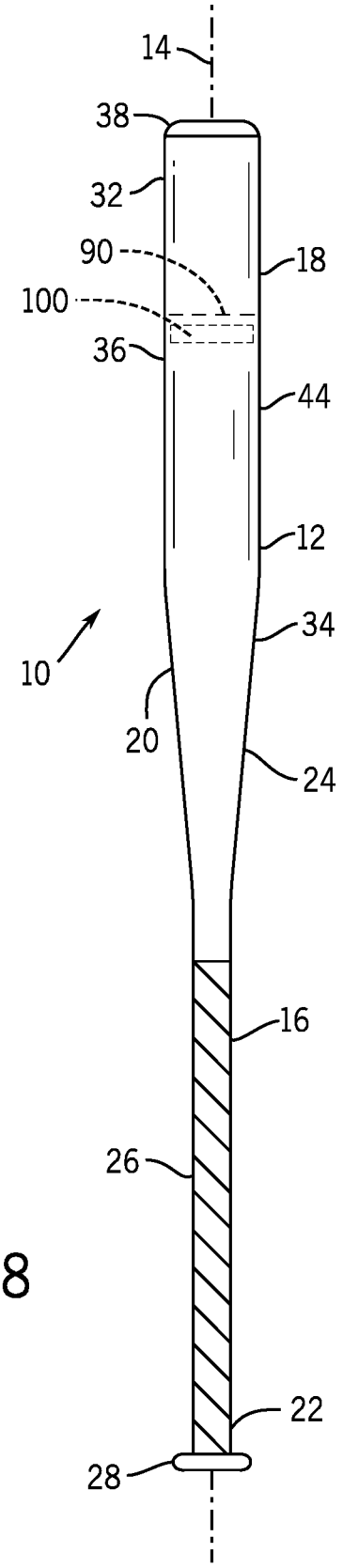
FIG. 8 is a side view of a ball bat in accordance with another implementation of the present invention.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material (or two or more different materials). In other implementations, such as shown in FIG. 8, the bat can be formed with a one-piece frame in which the handle portion, the intermediate tapered region and the barrel portion are one integral piece and the portions cannot be separated without destroying the frame.

Referring to FIG. 1, the handle portion 16 is an elongate structure having a proximal end region 22 and a distal end region 24, which extends along, and diverges outwardly from, the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

Figure 2:
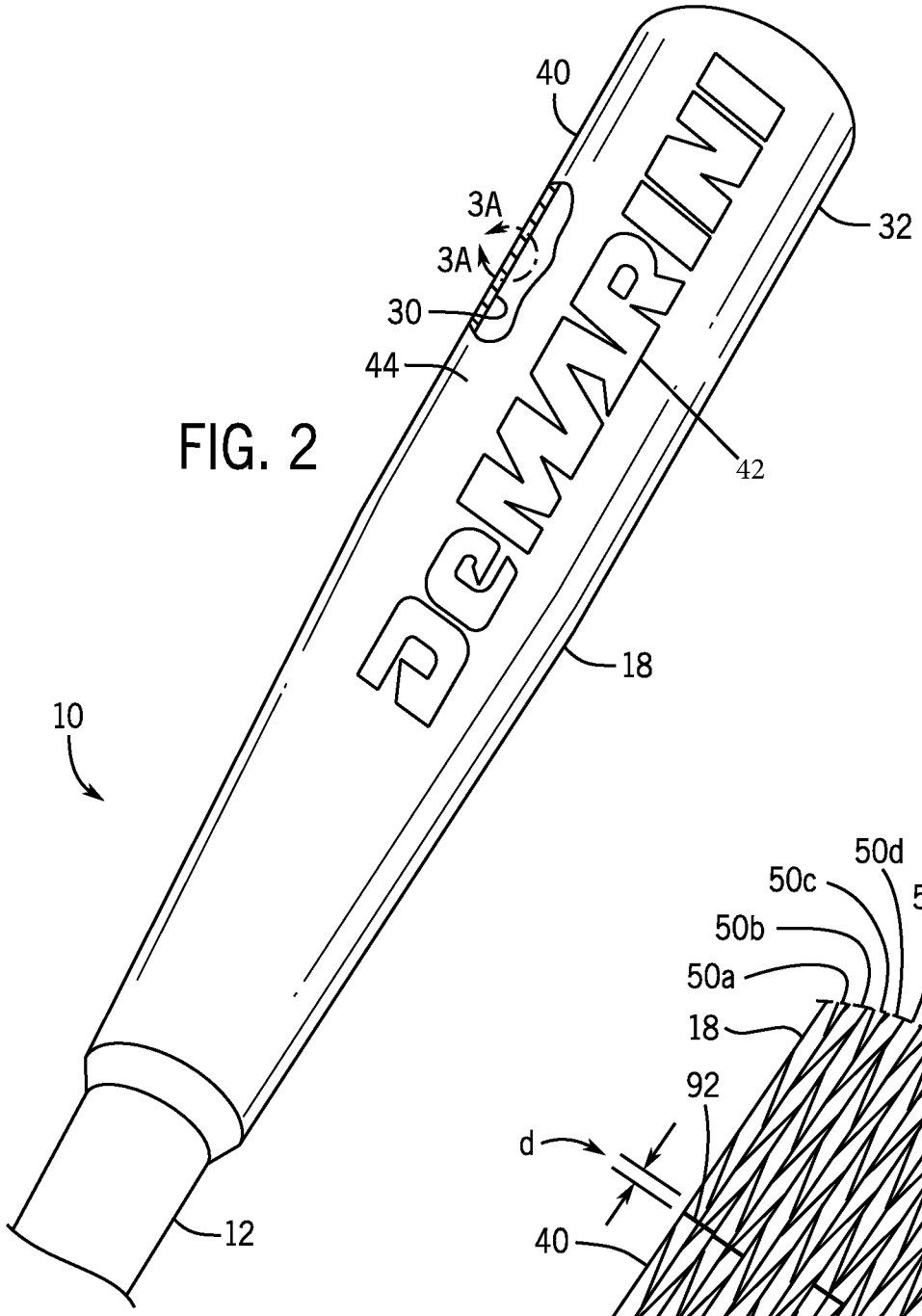
FIG. 2 is a side perspective view of a barrel portion of the ball bat of FIG. 1 including a sectional view of the wall of the barrel portion.

Referring to FIGS. 1 and 2, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has an inner surface 30, an outer surface 40, a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. In another implementation, the handle portion 16 can be a tubular body having a generally uniform diameter along its length and an intermediate member can be fixedly attached to the distal end region 24 for coupling the handle portion 16 to the barrel portion 18. The intermediate member can be used to space apart and/or attach the handle portion 16 to the barrel portion 18. The intermediate member can space apart all or a portion of the barrel portion 16 from the handle portion 16, and it can be formed of an elastomeric material, an epoxy, an adhesive, a plastic or any conventional spacer material. The bat 10 further includes an end cap 38 attached to the distal end 32 of the barrel portion 18 to substantially enclose the distal end 32.

The handle and barrel portions 16 and 18 can be coated and/or painted with one or more layers of paint, clear coat, inks, coatings, primers, and other conventional outer surface coatings. The outer surface 40 of the barrel portion 18 and/or the handle portion 16 can also include alpha numeric and/or graphical indicia 42 indicative of designs, trademarks, graphics, specifications, certifications, instructions, warnings and/or markings. Indicia 42 can be a trademark that is applied as a decal, as a screening or through other conventional means.

The barrel portion 18 includes a primary tubular ball impact region 44 that defines the region of the barrel portion 18 that is commonly or preferably used for impacting a ball during use. The ball impact region 44 includes the center of percussion ("COP") of the ball bat 10. The COP is typically identified in accordance with ASTM Standard F2219-09, *Standard Test Methods for Measuring High-Speed Bat Performance*, published in September 2009. The COP is also known as the center of oscillation or the length of a simple pendulum with the same period as a physical pendulum as in a bat oscillating on a pivot. In one implementation, the ball impact region 44 includes the center of percussion and an area plus and minus three inches from the center of percussion. In other implementations, the ball impact region 44 can have other lengths with respect to the longitudinal axis 14. The length of the ball impact region 44 is at least one inch, and can be positioned at any location along, or extend the entire length of, the barrel portion 18.

The barrel portion 18 is preferably formed of strong, durable and resilient material, such as, a fiber composite material. In alternative preferred embodiments, the barrel portion 18 can be formed of one or more fiber composite materials in combination with one or more of an aluminum alloy, a titanium alloy, a scandium alloy, steel, other alloys, a thermoplastic material, a thermoset material, and/or wood. In one implementation, the barrel portion 18 can be formed of a fiber composite material having wall thickness of at least 0.060 inch.

Figure 3A:
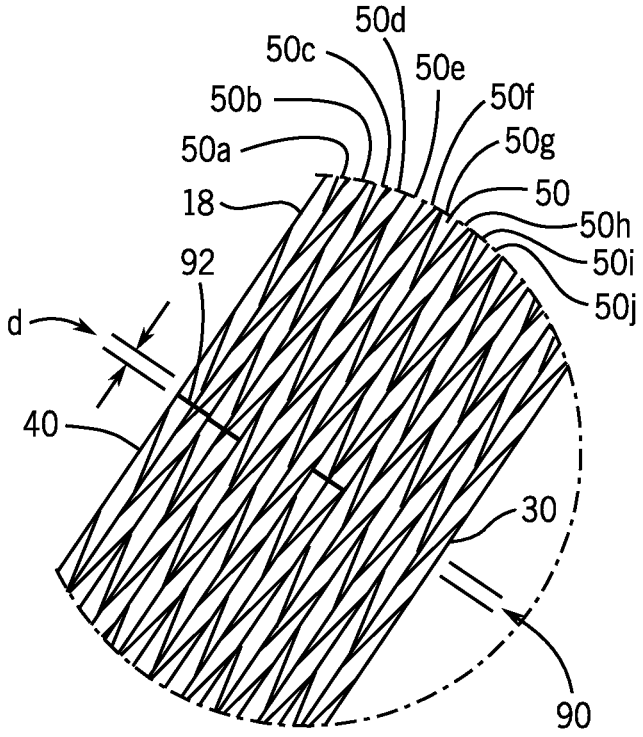
FIG. 3A is an enlarged view of a section of the wall of the barrel portion of the ball bat taken at circle 3 of FIG. 2.
Figure 4A:
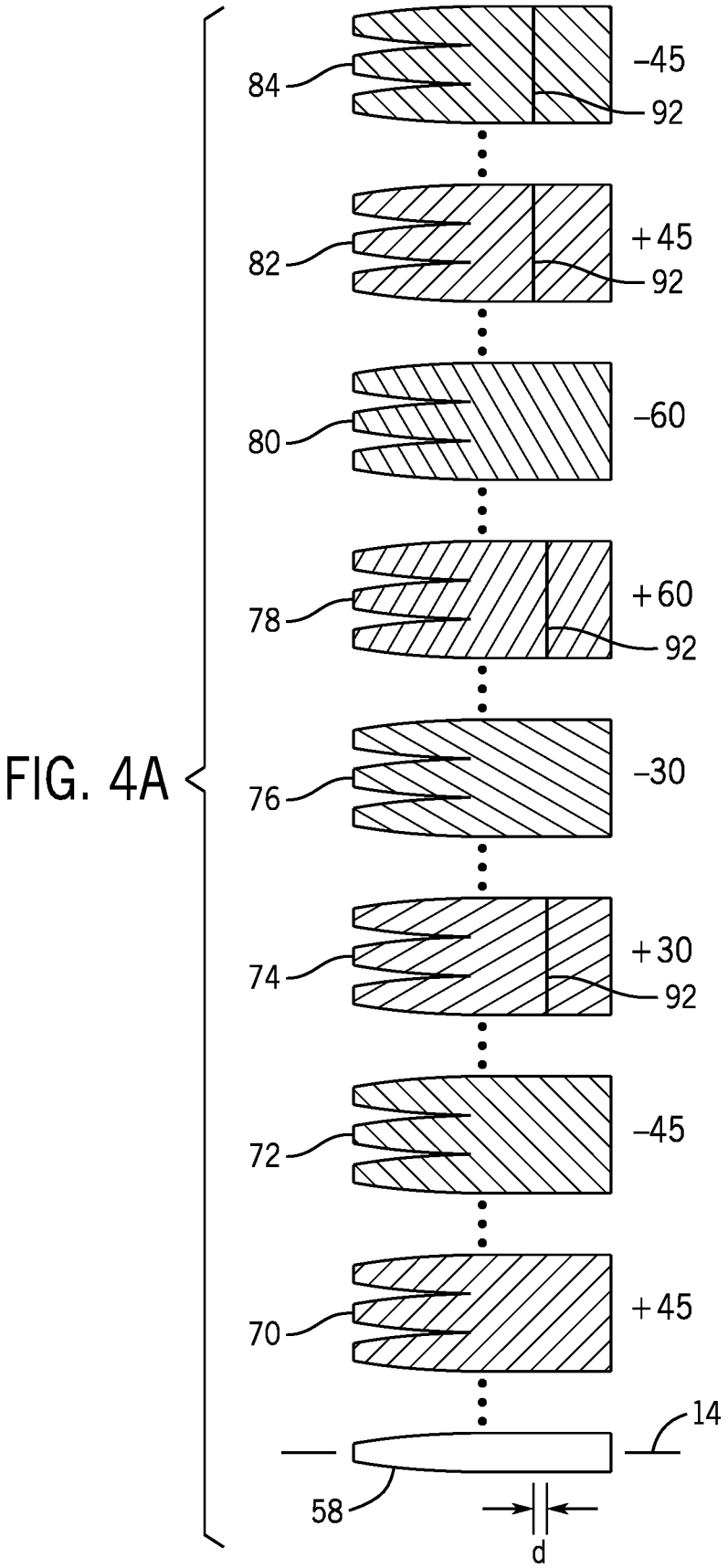
FIGS. 4A through 4C are side views illustrating example implementations of a plurality of layers of fiber composite material prior to wrapping around a bladder and mandrel in accordance with other implementations of the present invention.
Figure 5A:
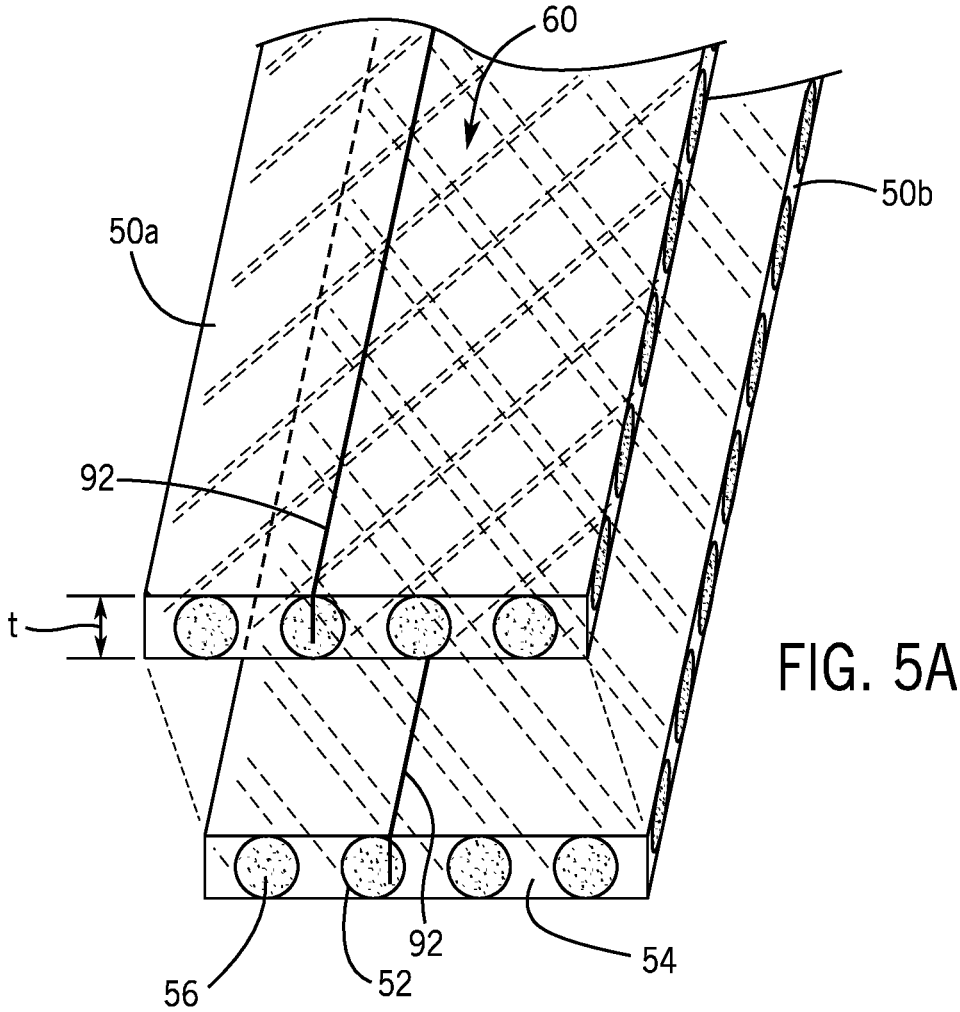
FIG. 5A is a top perspective view of a portion of two representative plies of fiber composite material spaced apart from each other in accordance with another example implementation of the present invention.
Figure 6:
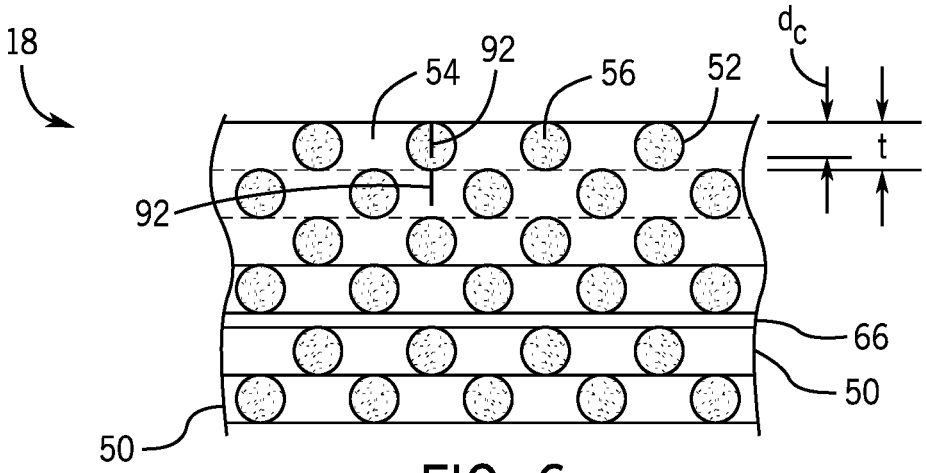
FIG. 6 is an enlarged sectional view of six outer plies of a fiber composite material of a primary tubular region of a barrel portion.

Referring to FIGS. 2, 3A, 4A, 5 and 6, a fiber composite material is preferably used to form at least a portion of the barrel portion 18. As used herein, the terms "composite material" or "fiber composite material" refer to a matrix or a series of plies 50 (also referred to as sheets or layers) of fiber bundles 52 impregnated (or permeated throughout) with a resin 54. Referring to FIGS. 4A, 5 and 6, the fiber bundles 52 can be co-axially bundled and aligned in the plies 50.

A single ply 50 typically includes hundreds or thousands of fiber bundles 52 that are initially arranged to extend coaxially and parallel with each other through the resin 54 that is initially uncured. Each of the fiber bundles 52 includes a plurality of fibers 56. The fibers 56 are formed of a high tensile strength material such as carbon. Alternatively, the fibers can be formed of other materials such as, for example, glass, graphite, boron, basalt, carrot, Kevlar®, Spectra®, poly-para-phenylene-2, 6-benzobisoxazole (PBO), hemp and combinations thereof. In one set of preferred embodiments, the resin 54 is preferably a thermosetting resin such as epoxy or polyester resins. The resin 54 can be formed of the same material from one ply to another ply. Alternatively, each ply can use a different resin formulation. During heating and curing, the resin 54 can flow between plies 50 and within the fiber bundles 52. The plies 50 preferably typically have a thickness within the range of 0.002 to 0.015 inch. In a particularly preferred embodiment, the ply 50 can have a thickness within the range of 0.005 to 0.006 in. In other alternative preferred embodiments, other thickness ranges can also be used.

The plies 50 are originally formed in flexible sheets or layers. In this configuration, the fibers 56 and the fiber bundles 52 are arranged and aligned such that the fibers 56 generally extend coaxially with respect to each other and are generally parallel to one another. As the ply 50 is wrapped or formed about a bladder 58 and mandrel, or other forming structure, the ply 50 is shaped to follow the form or follow the shape of the bladder 58 and mandrel. Accordingly, the fiber bundles 52 and fibers 56 also wrap around or follow the shape of the bladder 58 or other forming structure. In this formed position or state, the ply 50 is no longer in a flat sheet so the fiber bundles 52 and fibers 56 no longer follow or define generally parallel lines. Rather, the fiber bundles 52 and fibers 56 are adjacent to one another, and are curved or otherwise formed so that they follow substantially the same adjacent paths. For example, if a ply 50 is wrapped about the bladder 58, the ply 50 can take a generally cylindrical or tubular shape and the fiber bundles 52 and fibers 56 can follow the same cylindrical path or define a helical path (depending upon their angle within the ply 50). The fibers 56 remain adjacent to one another, are aligned with each other and follow substantially similar paths that are essentially parallel (or even co-axial) for example, when viewed in a sectional view in a single plane or other small finite segment of the ply 50.

The fibers 56 or fiber bundles 52 are preferably formed such that they extend along the ply 50 and form generally the same angle with respect to an axis, such as the axis 14. The plies 50 are typically identified, at least in part, by the size and polarity of the angle defined by the fibers 56 or fiber bundles 52 with respect to an axis. Examples of such descriptions of the plies 50 can be fibers 56 or fiber bundles 52 defining a positive 30 degree angle, a negative 30 degree angle, a positive 45 degree angle, a negative 45 degree angle, a positive 60 degree angle, a negative 60 degree angle, a positive 70 degree angle, a negative 70 degree angle, a positive 80 degree angle, a negative 80 degree angle, a 90 degree angle (extending perpendicular to the axis 14), and a 0 degree angle (or extending parallel to the axis 14). Other positive or negative angles can also be used. Accordingly, in the present application, a single ply 50 refers to a single layer of fiber composite material in which the fiber bundles 52 extend in substantially the same direction with respect to a longitudinal axis along the single layer, such as plus or positive 45 degrees or minus or negative 60 degrees.

Fiber composite material used to form at least a portion of the handle or barrel portions 16 or 18 of the bat 10 typically includes numerous plies 50. The number of plies 50 used to form a barrel portion 18 can be within the range of 3 to 60. In a preferred embodiment, the number of plies 50 used to form the barrel portion 18, or a primary tubular region thereof, is at least 10 plies. In an alternative preferred embodiment, the number of plies 50 used to form the barrel portion 18, or a primary tubular region thereof, is at least 20 plies. In other implementations, other numbers of plies can be used.

Referring to FIG. 5, fiber composite materials typically are formed or laid-up using pairs of plies 50 having fiber bundles 52 extending in opposite angular polarities. For example, a ply 50*a* formed of fiber bundles 52 and fibers 56 generally extending at a positive 45 degree angle (also referred to as a plus 45 degree ply) will be paired with a second ply 50*b* that is formed with fiber bundles 52 and fibers 56 generally extending at a negative 45 degree angle (also referred to as a negative 45 degree ply). This pattern typically extends throughout a fiber composite material. The alternating angular arrangement of the fiber bundles 52 and fibers 56 is important to achieving and maintaining the structural integrity of the component or structure being formed of the fiber composite material. The overlapped region of the two plies 50*a* and 50*b* can be essential for ensuring that, once cured, the fiber composite material has the desired strength, durability, toughness and/or reliability. The transition between alternating pairs of plies 50 can also support the structural integrity of the composite structure. For example, a series of six plies could include a pair of plus and minus 30 degree plies, followed by a pair of plus and minus 45 degree plies, followed by another pair of plus and minus 30 degree plies. The transition from the minus 30 degree ply to the adjacent plus 45 degree ply also provides added structural integrity to the fiber composite material because an overlapped region, such as region 60, still exists from one ply to an adjacent ply. In other implementations, pairs of plies 50 having opposite polarities but differing fiber angles can be used. In still other implementations, two or more plies can be of the same polarity, such as disclosed by U.S. Pat. Nos. 8,858,373 and 8,852,037.

Handle and barrel portions 16 and 18 formed of fiber composite material can include several layers of plus and minus angular plies of different values, such as, for example, plus and minus 30 degree plies, plus and minus 45 degree plies, plus and minus 60 degree plies. One or more layers of 0 degree plies, or 90 degree plies can also be used. Referring to FIG. 6, the plies 50 may be separated at least partially by one or more scrims 66 or veils. The scrim 66 can be used to enable independent movement of the plies 50 above and below the scrim 66 during use after the barrel portion 18 is molded and cured. The scrim 66 can also be used to inhibit, stop or reduce resin flow from one ply 50 to another ply on the opposite side of the scrim 66.

The composite material is typically wrapped about a mandrel that is covered by a bladder 58, the bladder 58 and mandrel once wrapped with the desired number of plies 50 of fiber composite materials is placed into a mold, pressure is applied to the bladder, and the fiber composite material is molded and cured under heat and/or pressure to produce the barrel portion 18 and/or a primary tubular region thereof. While curing, the resin is configured to flow and fully disperse and impregnate the matrix of fiber bundles 52. In alternative embodiments, one or more of the plies, sheet or layers of the composite material can be a braided or weaved sheets or layers. In other alternative preferred embodiments, the one or more plies or the entire fiber composite material can be a mixture of chopped and randomly dispersed fibers in a resin.

Referring to FIG. 4A, one implementation of a lay-up of a barrel portion 18 of a bat 10 can be seen. Separate plies 50 are shown, each having separate fiber angles and polarities. The plies 50 are shown as generally flat two-dimensional sheets prior to being placed or wrapped about the bladder 58 positioned over a mandrel. The mandrel is formed in a shape that defines the inner volume of a tubular barrel portion upon the completion of the molding and curing. The bladder 58, when placed in the mold, is pressurized to exert a force or pressure onto the plies 50 ensuring that the plies conform to the shape of the mold and achieve proper compaction, and the desired wall thickness, etc. For example, the bladder can be pressurized to 150 psi. In other molding operations, other pressure values can be used. The bladder 58 and mandrel can be formed of any material that maintains its shape and integrity during the curing process, such as a polyurethane bladder over a wooden mandrel. Once the bladder 58 is in position, the process of "laying up" the plies 50, or layers, comprising the fiber composite material can be performed. The shape and overall size of the plies 50 can vary from one to another. Each ply can be sized to extend about all or a portion of the underlying bladder 58/mandrel or the underlying ply 50. Preferably, the ply 50 is sized to extend or wrap around the entire or full circumference of the bladder and about the axis 14. A plurality of uncured plies 50 of fiber composite material can be wrapped or otherwise applied about the bladder 58.

Once the lay-up of the desired number of plies 50 is completed, the bladder 58 and mandrel with the wrapped composite layers or plies are placed into a mold, the bladder is pressurized, the mold is heated to form (mold and cure) the barrel portion 18. After curing, the bladder 58 and the mandrel can be removed from the inner surface of the barrel portion 18 through conventional means, such as, for example, extraction or heating.

In some applications, it is desirable to produce a barrel portion formed of fiber composite material having high angle fibers (fiber composite material having fiber angles of 45 degrees or greater). The use of high fiber angles for the production of unidirectional fiber composite components, including a barrel portion or cylindrical portions of a barrel portion, can be desirable because the stiffness of the barrel portion, or a primary tubular region thereof, can be greatly increased without adding to the weight or the wall thickness of the barrel portion.

Referring to FIG. 4A, in one implementation a ply 70 represents the innermost ply 50 or layer applied to the bladder 58, a ply 72 is positioned over ply 70. In one preferred method of laying up the barrel portion 18, the plies 70 and 72 can be initially laid over each other and then wrapped over about the barrel portion as a pair of plies having opposite polarities. In other preferred methods, a single ply or three or more plies can be applied or wrapped about the bladder/mandrel as a single ply layer or a triple or higher ply layer. Plies 74 through 84 illustrate one potential lay-up of layers to a bladder/mandrel. Each of the plies 74 through 84 includes fibers angled with respect to the longitudinal axis 14. In the example implementation of FIG. 4A, the plies 70 through 84 include fibers angled with respect to the longitudinal axis by +45 degrees, −45 degrees, +30 degrees, −30 degrees, +60 degrees, −60 degrees, +45 degrees and −45 degrees, respectively. However, in other implementations, other numbers of angled plies can be used in the lay-up, laminate or wall thickness of the molded barrel portion 18 or primary tubular region thereof.

As discussed in the Background, many existing and new equipment standards and/or requirements require bats that include a barrel formed of a composite material to undergo an accelerated break-in test procedure wherein the bat is repeatedly rolled in a barrel rolling procedure and then performance tested to measure the peak BBCOR of the bat until the bat fails or shows evidence of failing. One example is the NCAA's Bat-Ball Coefficient of Restitution (BBCOR) testing protocol, updated on Aug. 1, 2016, which requires the measurement of barrel compression in accordance with ASTM F2844 and then the rolling of the bat using a barrel rolling procedure.

Figure 7:
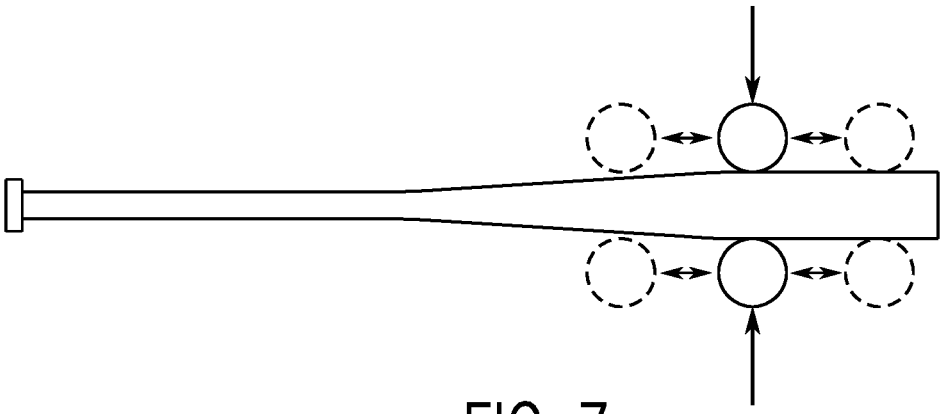
FIG. 7 is a representation of a bat rolling procedure on a ball bat and is a reproduction of FIG. 1 of the NCAA Standard for Testing Baseball Bat Performance, Bat-Ball Coefficient of Restitution.

The barrel rolling procedure requires a bat rolling apparatus that includes two wheels, a fixture for pressing the wheels into the bat barrel in increments up to 0.012 inch, and a device to roll the barrel. The wheels are formed of a durable material such as nylon and have a diameter within the range of 1.5 to 3.0 inches. Following rolling of the bat, the BBCOR is measured using a bat test procedure. The bat rolling and bat performance testing is continued until the bat fails or exhibits a decrease of BBCOR value by more than 0.018 from the maximum value. The barrel of the bat is placed into the fixture and marked with a 0 degree orientation as identified in ASTM F2844. As shown in FIG. 7, the rollers are brought into contact with the barrel. The rollers are then displaced approximately 0.050 in for the initial rolling. For subsequent rolling, the displacement is increased by up to 0.012 inch. The barrel is rolled to within 2.0 to 2.5 in of the endcap and past the taper (or area of no contact between the rollers and the bat). The bat is rolled approximately 10 times in each direction. The bat is then unloaded. The bat is then clocked (or rotated) 45 degrees about its longitudinal axis, and the bat rolling steps are repeated. The bat rolling is repeated again after clocking the bat to 90 degrees and 135 degrees from its original position. The barrel compression is then re-measured using ASTM F2844. The rollers are displaced and the bat rolling steps are repeated until the barrel compression from rolling decreases by 5 percent.

The 2018 USABat standard also requires performance of an accelerated break-in procedure including a bat rolling procedure. When performing ABI tests, in order for a bat with a composite barrel to pass the test, the composite barrel bats must either fail (break) at some point during the test or show evidence of failing, cracking or crack initiation (depending upon the particular bat standard).

The present invention includes bat configurations, bat constructions and bat manufacturing methods that result in a ball bat with a composite barrel that performs well and includes a predictable and engineered failure area or ABI fuse region. The ABI fuse region enables the bat with the composite barrel to pass applicable bat standards which include ABI testing requirements and also provide a region that indicates whether the bat has been tampered with (by a bat doctor or the like) or whether the bat has passed its useful life.

The present invention involves introducing a discontinuity in a location on the bat barrel which can cause or result in a catastrophic failure of the bat barrel when the barrel is subjected to the rolling portion of an ABI test.

FIG. 3A illustrates one example implementation of a barrel portion 18 of a bat formed of fiber composite material that includes an ABI fuse region 90. The ABI fuse region 90 relates to a bat composition and/or structure that enables the bat to perform during normal or intended use, but fail or show indications of failure when subjected to an accelerated break-in (ABI) test or procedure including a bat rolling procedure. Prior to laying up the composite plies 50 onto a bladder/mandrel 58 and then curing the laid-up or "stacked-up" structure, the individual plies 50 (or layers or flags) of composite material are cut or sliced into two pieces forming a cut or discontinuity 92 in the ply 50. The cutting or slicing of the ply 50 creates a discontinuity in the fibers making up the ply 50. The cut 92 or slice can be applied to one or more plies 50 in the stack-up, and the cuts 92 or slices are generally aligned with each other such that at least a portion of the cut 92 or slice of one ply 50 overlies the cut 92 or slice of a second ply or more plies. In one implementation the cuts 92 or slices aligned so that the cuts 92 overlie each other within a longitudinal discontinuity dimension, d, within the range of 0 to 0.1 inch. In other implementations, the longitudinal discontinuity dimension, d, can be within the range of 0 to 0.25 inch.

In the example embodiment of FIG. 3A, a total of 16 plies 50 are illustrated in the barrel portion 18 or the wall thickness of the barrel portion 18. The barrel portion 18 of FIG. 3A is shown in a final manufactured state after the composite plies have been laid up about the bladder/mandrel 58, placed under heat and/or pressure and cured. During the composite molding and curing process, the viscosity of the resin decreases such that the resin 54 flows throughout the ply 50 and other adjacent plies 50. Accordingly, the cuts 92 are made prior to wrapping, laying up and curing the plies 50, once cured the cuts 92 are present in the fibers 52 but the resin 54 has flowed to fill the space or void created by the cuts 92. The cuts 92 are shown in 6 separate plies 50 of an example stack up of 16 plies 50. The outermost plies 50*a*, 50*b*, 50*c* and 50*d* each include a cut 92. The next set of four plies 50*e*, 50*f*, 50*g* and 50*h* are formed without a cut or a discontinuity. The next two plies 50*i* and 50*j* include a cut 92. The cuts 92 formed in plies 50*a*, 50*b*, 50*c*, 50*d*, 50*i* and 50*j* are all generally aligned with each other such that the cuts 92 or discontinuities substantially overlie each other within the longitudinal discontinuity dimension d.

Figure 3B:
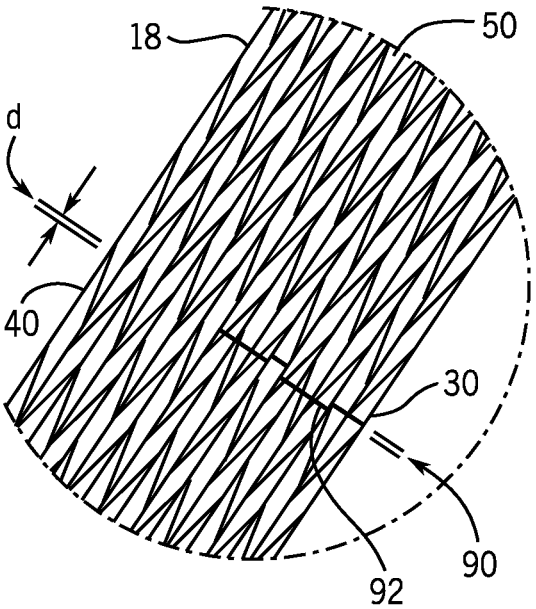
FIGS. 3B through 3E are enlarged views of a section of a wall of a barrel portion of a ball bat taken at circle 3 of FIG. 2 in accordance with other example implementations of the present invention.
Figure 3C:
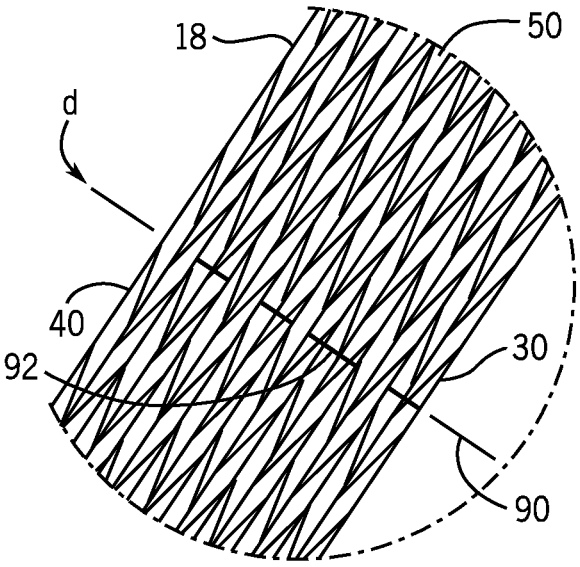
Figure 3D:
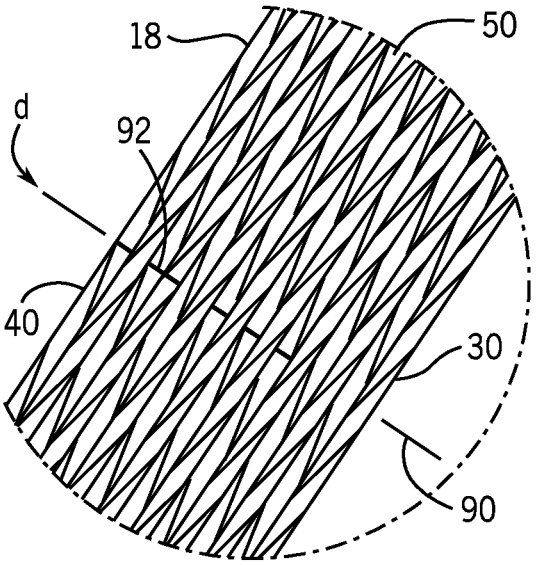
Figure 3E:
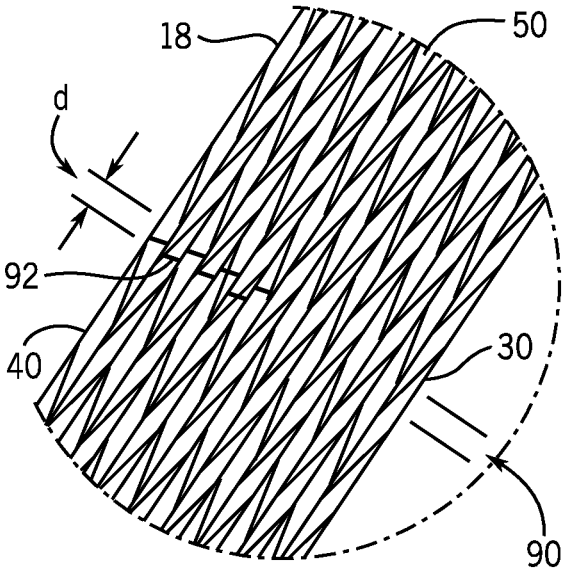

Referring to FIGS. 3B through 3E, other example implementations of cuts 92 placed into plies 50 of a laid-up structure forming the barrel portion 18 of the bat 10 are illustrated. The number of plies 50 that include cuts 92 can vary in the composite structure. The position and spacing of the cuts 92 in the composite structure and between the plies 50 can also vary. The size of the longitudinal discontinuity dimension, d, forming the ABI fuse region 90 can also vary. Still further, the angle of cuts 92 can be varied. In some implementations, the cuts 92 are substantially perpendicular to the longitudinal axis 14 of the bat 10. In other implementations, the cuts 92 can be angled from 30 to 89 degrees from the longitudinal axis 14. FIG. 3B illustrates the composite barrel portion 18 having 8 plies with cuts 92, the 8 plies are stacked directly upon each other, and are positioned toward the inner surface 30 of the barrel portion 18. The longitudinal discontinuity dimension d is less than 0.1 inch. FIG. 3C illustrates an example implementation where the cuts 92 are in 8 plies 50 that are arranged in spaced apart pairs of plies 50 throughout the lay-up of the barrel portion 18. The longitudinal discontinuity dimension d is less than 0.025 inch. FIG. 3D illustrates another example implementation where the cuts 92 are in 7 plies 50 that are arranged in generally random order throughout the outer two thirds of the lay-up of the barrel portion 18. The longitudinal discontinuity dimension d is less than 0.02 inch. FIG. 3E illustrates another example implementation where the cuts 92 are in the 7 outermost plies 50 of the barrel portion 18. The cuts 92 are angled with respect to the longitudinal axis 14. The longitudinal discontinuity dimension d is less than 0.25 inch.

Figure 4B:
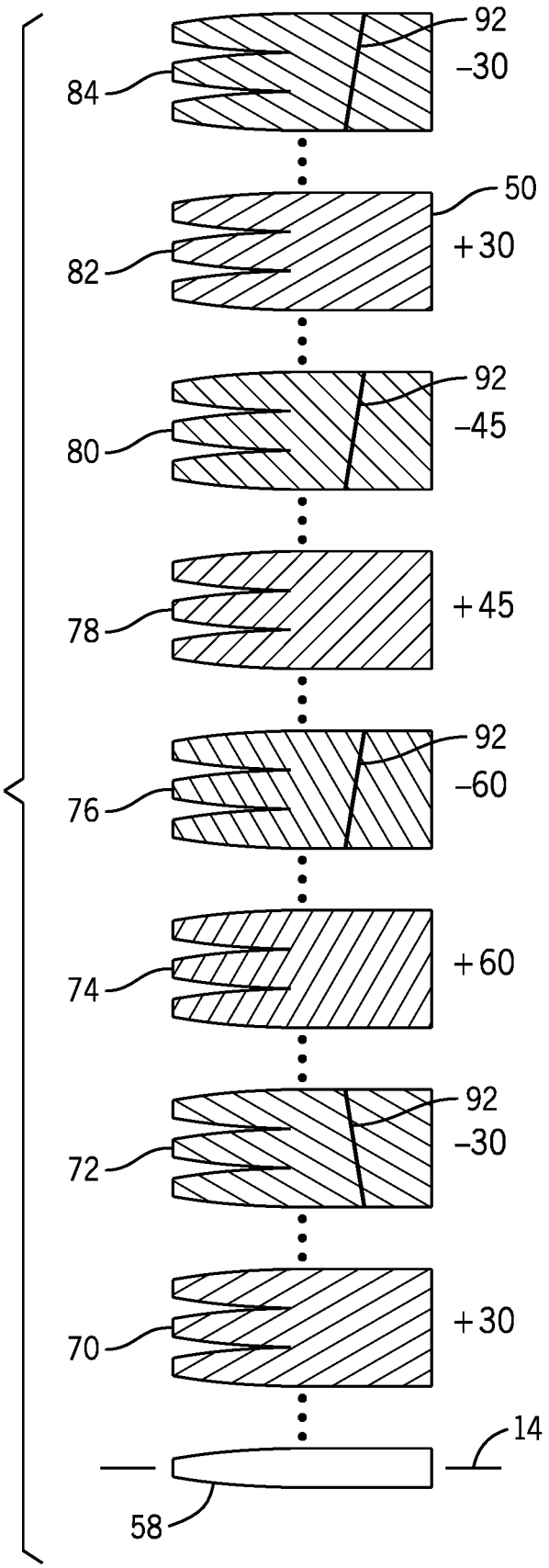
Figure 4C:
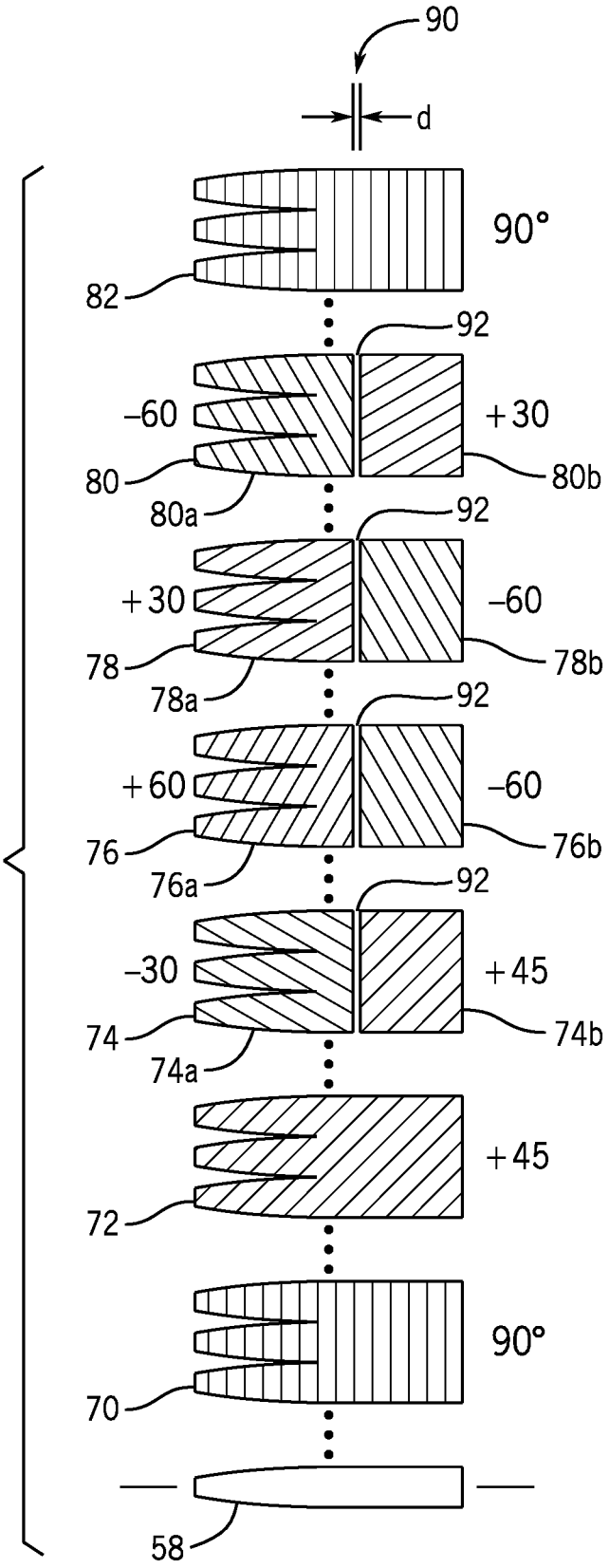

Referring to FIGS. 4A through 4C, other example implementations of the present invention are illustrated. In FIGS. 4A through 4C, the plies 70 through 84 are specific examples of plies 50 shown in the order in which they are laid up onto the bladder/mandrel 58. In FIG. 4A, the cuts 92 are illustrated on four of the eight plies (plies 84, 82, 78 and 74). The plies 84, 82, 78 and 74 include cuts 92 that are made substantially perpendicular to the longitudinal axis 14 of the mandrel which corresponds to the longitudinal axis 14 of the bat. FIG. 4B illustrates an example implementation where the cuts 92 are angled with respect to the longitudinal axis 14 by approximately 75 degrees. Plies 72, 76, 80 and 84 include cuts 92.

FIG. 4C illustrates another example implementation, in which the four of the plies are formed of two flag segments and each flag segment can include a different fiber angle. For example, ply 80 can be formed by flag segments 80*a* and 80*b* which are arranged end to end to form a discontinuity or cut 92. Flag segment 80*a* includes fibers generally extending at an angle of minus 60 degrees with respect to the longitudinal axis 14, and flag segment 80*b* includes fibers generally extending at angle of plus 30 degrees with respect to the longitudinal axis 14. In ply 80, the discontinuity or cut 92 formed by the abutting of the two flag segments 80*a* and 80*b* and the difference in fiber angle from flag segment 80*a* and flag segment 80*b* further contributes to likelihood a crack initiation occurring at the ABI fuse region 90 during a barrel rolling test of an ABI procedure. Plies 74, 76 and 78 are also formed by a pair of flag segments 74*a* and 74*b*, 76*a* and 76*b*, and 78*a* and 78*b*. As shown, the angles of the fibers can vary from one flag segment to the next.

The barrel portion 18 including a proximal region 34 and a distal region 32, and the barrel portion can be formed of a fiber composite material including at least first and second plies. The first ply can be ply 80 which can include the flag segment 80*a* (or first proximal ply portion) and the flag segment 80*b* (or first distal ply portion). The ABI fuse region 90 is the first fiber discontinuity that separates the flag segments 80*a* and 80*b*. The first plurality of fibers of the flag segment 80*a* are generally aligned to define first proximal angle with respect to the longitudinal axis 14, and the first plurality of fibers of the flag segment 80*b* are generally aligned to define first distal angle with respect to the longitudinal axis 14. In one implementation, the first proximal angle and the first distal angle can vary by at least 10 degrees. In another implementation, the first proximal angle and the first distal angle can vary by at least 30 degrees.

Referring to FIGS. 5A and 6, in another example implementation of the present invention, the cut 92 can extend through only a portion of the ply 50 and/or only through a portion of the fiber bundles 52. In FIGS. 5A and 6, ply 50 has a thickness t and the cut 92 has a cut depth, $d_c$, that is approximately 75 percent of the size of the thickness t. In another implementation the depth of the cut $d_c$ can be at least 50 percent of the thickness t of the ply 92. In one implementation, the cut depth $d_c$ is within the range of 33 to 100 percent of the ply thickness t. In another implementation, the cut depth $d_c$ is within the range of 50 to 100 percent of the ply thickness t.

When the cut depth $d_c$ is less than 100 percent of the ply thickness t, the ply 50 can be more readily positioned and handled during lay-up or stack-up of the composite structure, such as the barrel portion 18. Because the cut 92 is formed before the plies 50 are cured, a cut 92 extending entirely through the ply 50 can make the ply more difficult to handle and/or work with. Accordingly, in some implementations, the cuts 92 are made at a cut depth that is less than the entire thickness of one or more plies 50. Cuts 92 that do not extend entirely through the ply thickness t still serve to create a discontinuity that can form an ABI fuse region.

Figure 5B:
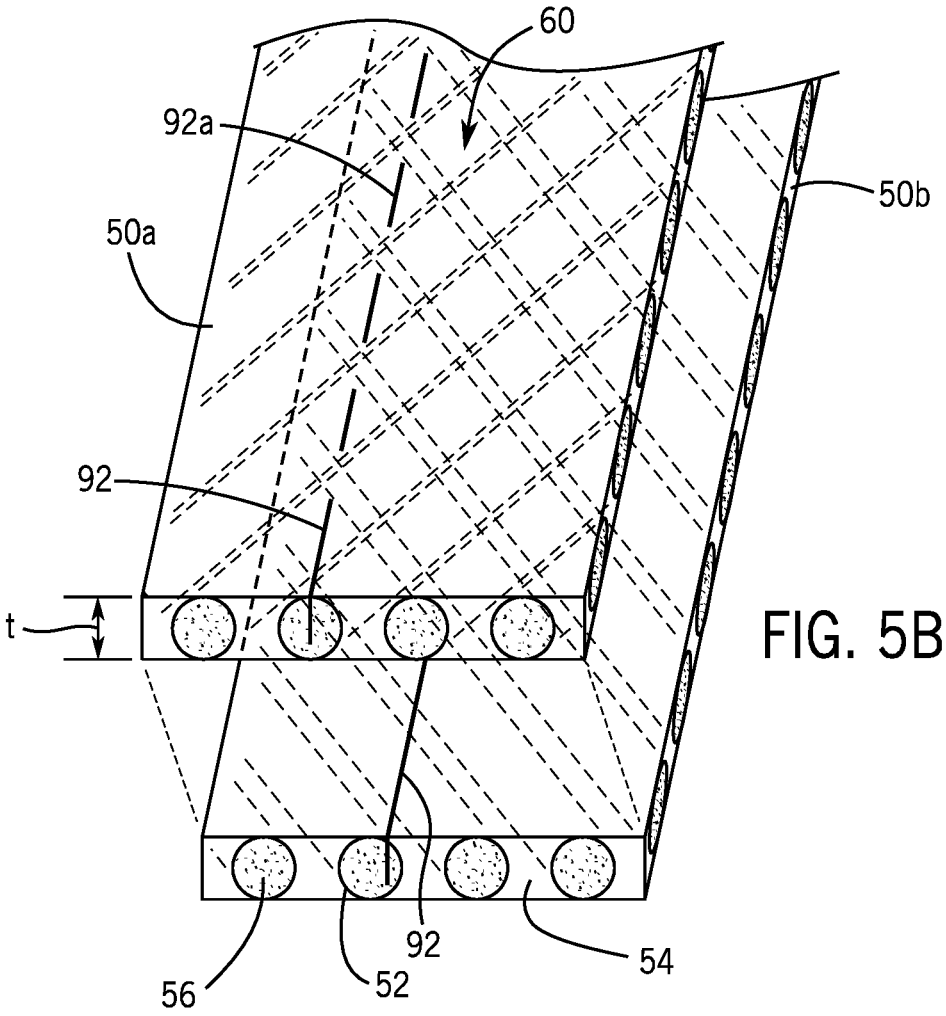
FIG. 5B is a top perspective view of a portion of two representative plies of fiber composite material spaced apart from each other in accordance with another example implementation of the present invention.

Referring to FIG. 5B, another example implementation of a cut 92 or discontinuity is illustrated. The cut can also be formed as a plurality of spaced apart cut segments 92*a* that collectively represent the cut 92 in ply 50*a*. The spaced apart cut segments 92*a* can extend entirely through the thickness t of the ply 50 or through a portion of the thickness t of the ply 50, also referred to as the depth of the cut $d_c$, as shown in FIG. 5B. The length of each cut segment 92*a* can be varied. Additionally, the size of the distance between the cut segments 92*a* can also be varied. The spaced apart cut segments 92*a* have a similar effect of creating a discontinuity that can be used to form the ABI fuse region 90. Adjacent plies, such as ply 50*b* can include a continuous cut 92. In other implementations, the adjacent plies, such as ply 50*b*, may also include spaced apart cut segments 92*a*, or no cut 92.

FIGS. 3A through 6, illustrated example implementations of the present invention. However, other implementations are contemplated in the present invention. The number of plies 50 used to form the composite structure such as the barrel portion 18 can be varied. The angles of the fibers within the plies 50 can be varied from ply to ply from one lay-up to another. The number of cuts 92 in a lay-up or stack-up can be varied from one application to another. The type of cuts 92 (the angle, depth, and length—segmented or non-segmented) can be varied. The depth $d_c$ of the cut 92 of a ply 92 can also be varied from one ply to another ply. The use of flag segments to produce a ply can be used in one or more of the layers of a lay-up or stack up. The fiber angle of the fibers in adjacent flag segments can also be varied. The size of the longitudinal discontinuity dimension d can also be varied. The present invention presents a significant number of different implementations of fibers, fibers angles, cuts, cut angle, cut sizes, cut depths, etc. that result in an almost infinite number of combinations available for producing an ABI fuse region in a ball bat. Through use of these various cuts and discontinuities, a bat can be designed and customized for any application. The present invention also enables a bat designer to produce a bat with an ABI fuse region that will produce reliable consistent results on the field and in certification or qualification testing.

Figure 9:
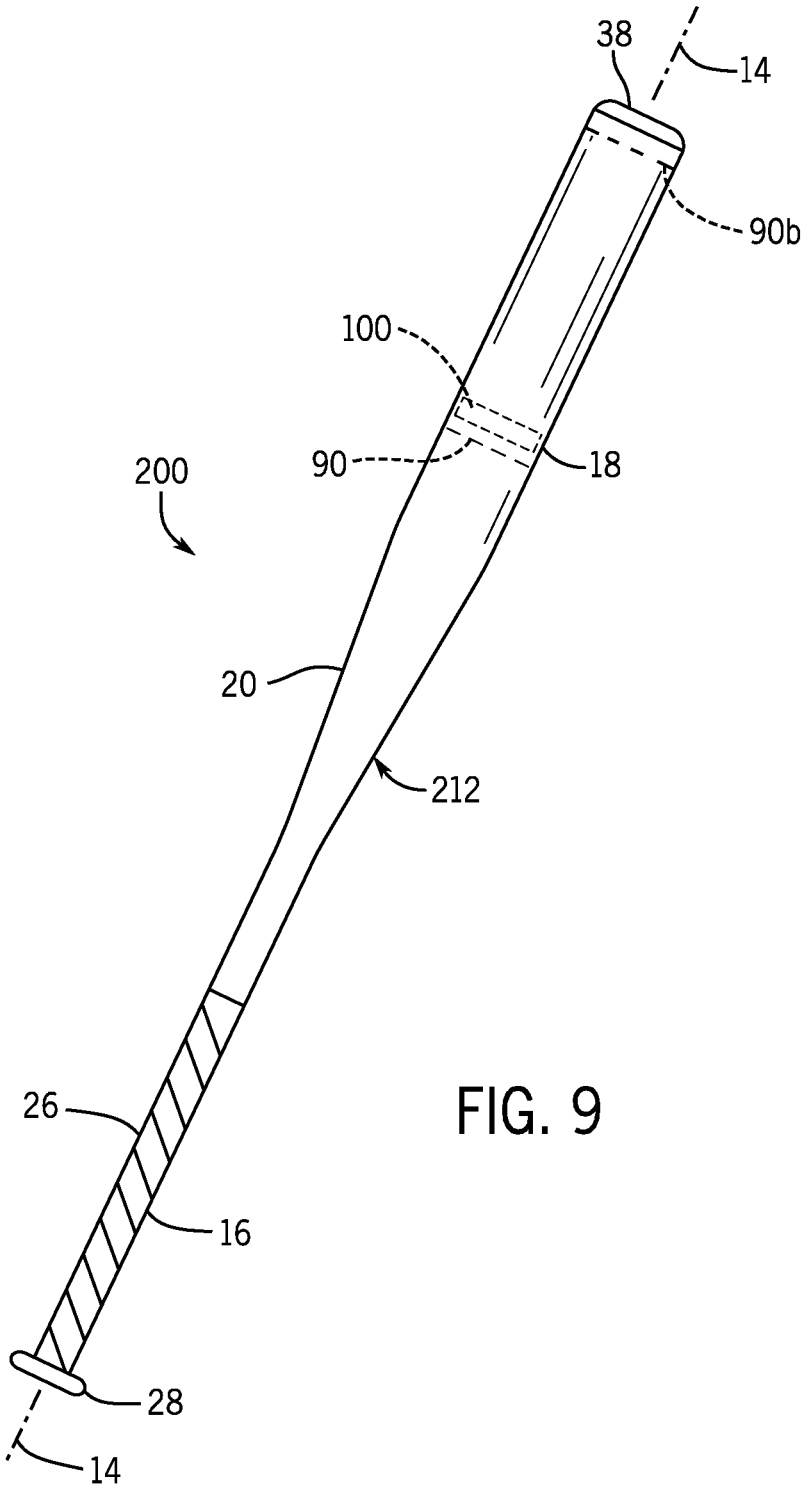
FIG. 9 is a side view of a ball bat in accordance with another implementation of the present invention.

Referring to FIGS. 8 and 9, in other implementations, a stiffening element 100 can be longitudinally positioned in barrel portion 18 of the bat 10 so as to be adjacent to the ABI fuse region 90 formed in the construction of the barrel portion 18. The stiffening element 100 can take a variety of different forms, shapes, constructions, sizes, and/or materials. The stiffening element 100 serves to increase the compressive strength, or the displacement compression, of the bat 10 at the axial location of the stiffening element 100 and at regions directly adjacent to the stiffening element 100. The effect of the stiffening element 100 on the stiffness of the barrel portion 18 of the bat 10 can be shown by performing a displacement compression test of softball and baseball bat barrels such as described in ASTM Std. No. F2844-11 with the stiffening element 100 installed and with the stiffening element 100 removed or absent from the bat barrel portion 18. Using ASTM Std. No. F2844-11, or an equivalent test, a measure of the barrel compression BC of a bat can be determined using a barrel compression test apparatus such as shown in FIG. 1 of ASTM Std. No. F2844-11.

In FIG. 8, a bat 10 formed with a separate handle portion 16 and barrel portion 18 is shown with the stiffening element 100 longitudinally positioned adjacent the ABI fuse region 90 on the handle portion side of the ABI fuse region 90. In FIG. 9, a bat 200 formed of a one piece, integral bat frame 212 is shown in which the handle portion 16 is continuously and integrally formed with a tapered region 20 and the barrel portion 18. The term one piece, integral bat frame means that the handle portion 16 cannot be separated from the barrel portion 18 without destroying or damaging one or both of the handle portion 16 or the barrel portion 18. The bat 200 includes a stiffening element 100 that is longitudinally positioned within the barrel portion 18 of the bat 200 so as to be closer to the end cap 38 or distal end of the bat 200. FIGS. 8 and 9 illustrate that the ABI fuse region 90 can be longitudinally positioned on either side of the stiffening element 100. In other implementations, a bat can include two or more ABI fuse regions 90 positioned on either side of a stiffening element 100, or two or more stiffening elements 100 positioned on either side of an ABI fuse region 90.

In one implementation, the stiffening element 100 is longitudinally spaced apart from the ABI fuse region 90 by a distance within the range of 0.1 to 1.0 inch. In other implementations, the stiffening element 100 is longitudinally spaced apart from the ABI fuse region 90 by a distance within the range of 0.2 to 0.75 inch. In other implementations, the stiffening element 100 can be longitudinally spaced apart from the ABI fuse region 90 by other distances outside of these ranges. If an ABI fuse region 90 is placed on either side of the stiffening element 100, the distance from the stiffening element 100 to each of the ABI fuse regions can be the same or can be varied.

The placement of the stiffening element 100 adjacent to the ABI fuse region 90 creates additional stress or loads upon the ABI fuse region 90 such that when the bat is subjected to an accelerated break-in test the differential in barrel compression between the barrel portion 18 at the stiffening element 100 and the barrel compression of the barrel portion at the ABI fuse region facilitates failure or cracking of the barrel portion 18 at the ABI fuse region 90. The barrel compression of the barrel portion 18 at the ABI fuse region 90 is lower than the barrel compression of the barrel portion 18 at the location of the stiffening element 100 which accentuates or increases the stress placed upon the barrel portion at or near the ABI fuse region 90 during the performance of an ABI break-in test. The stiffening element 100 creates a sudden change in barrel stiffness that can force a failure or catastrophic failure of the bat barrel portion 18 during the bat rolling procedure of the ABI break-in test.

The stiffening element 100 can be any structure that stiffens the barrel portion 18 and increases the barrel compression value of the barrel portion 18 at the location of the stiffening element 100. The stiffening element 100 can be integrally formed with the barrel portion as shown in FIG. 14, or can be a separate component that is positioned within the barrel portion 18. Accordingly, the stiffening element 100 can be molded and cured with the barrel portion, it can be co-molded with the barrel portion, it can be press-fit within the barrel portion, it can be attached to the barrel portion using an adhesive, it can be coupled to the barrel portion through an intermediate layer, or coupled in other manners, or in any combination of the above-mentioned manners. The stiffening element 100 can be an annular member that includes one or more central openings (such as FIG. 10*a*) or it can be a disc member (such as FIG. 11A) that provides a substantially uniform structure across the hollow barrel portion 18. In another implementation, the stiffening element 100 can be a polygonal or irregular shaped structure that is positioned within the barrel portion and includes at least 3 points of contact between the stiffening element 100 and the inner surface 30 of the barrel portion 18. The stiffening element 100 is preferably formed of a lightweight, rigid material such as aluminum or polycarbonate. In other implementations, other materials can be used such as other metals, other polymeric materials, wood, ceramic, elastomers, and combinations thereof.

Figure 10A:
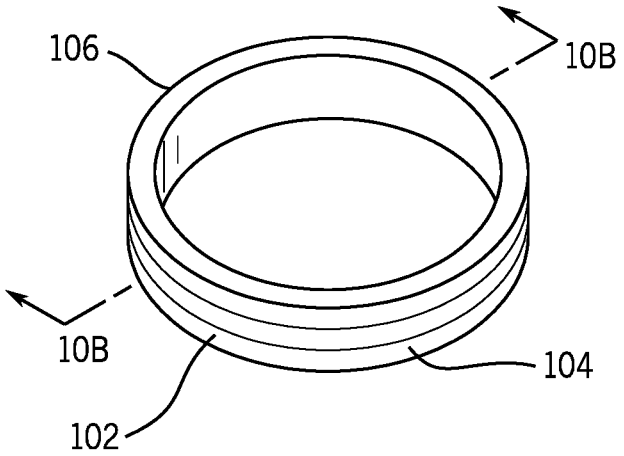
FIG. 10A is a top, side perspective view of an annular stiffening element in accordance with an example implementation of the present invention.
Figure 10B:
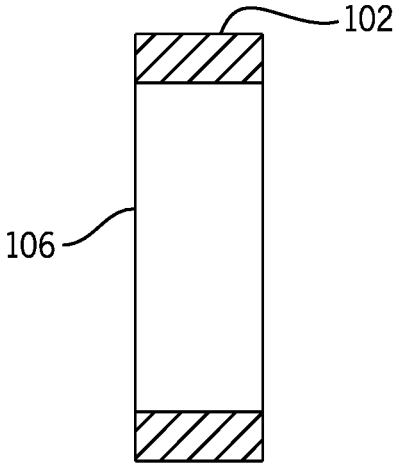
FIG. 10B is a cross-sectional view of the annular stiffening element of FIG. 10A.

Referring to FIGS. 10A and 10B, one example implementation of the stiffening element 100 is illustrated. The stiffening element 100 of FIGS. 10A and 10B is annular member having an outer surface 102 configured for engagement with the inner surface 30 of the barrel portion 18. In one implementation, the outer surface 102 can be roughened or include serrations 104 or other structure for increasing the engagement with the barrel portion. In other implementations, the outer surface 102 of the stiffening element 100 can be generally smooth and attached to the inner surface 30 of the barrel portion 18 through a press-fit connection, an adhesive, thermal bonding, welding, other connection techniques or combinations thereof. The annular shape of the stiffening element 100 forms or defines an opening 106. Referring to FIG. 10B, the stiffening element 100 has a rectangular cross-sectional shape. The thickness and length of the stiffening element 100 can be varied to match a particular application or bat design.

Figure 10C:
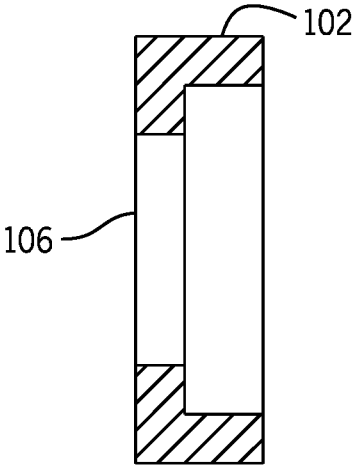
FIGS. 10C and 10D are cross-sectional views of annular stiffening elements in accordance with other example embodiments of the present invention.
Figure 10D:
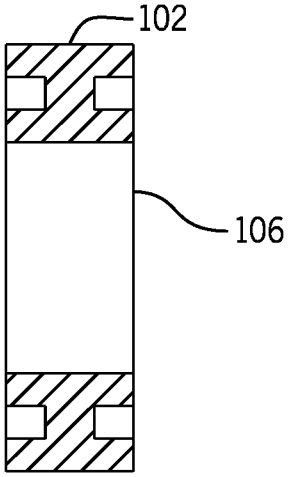

Referring to FIGS. 10C and 10D, the stiffening element 100 can be formed in annular shape with different cross-sectional shapes. The stiffening element 100 of FIG. 10C has a generally L-shaped cross-sectional shape and the stiffening element of FIG. 10D has a generally I-shaped cross-sectional shape. When the stiffening element 100 has a non-symmetrical cross-sectional shape, such as FIG. 10C, the stiffening element 100 can be installed within the barrel portion 18 of the bat 10 with the thicker portion of the stiffening element 100 positioned closer to the handle portion 16 of the bat or closer to the end cap 38 of the bat as desired for a particular application or purpose. In other implementations, the stiffening element 100 can have an annular shape with other cross-sectional shapes such as, for example, generally U-shaped, generally T-shaped, generally V-shaped, square shaped, semi-circular, semi-ovular, other curved shapes and other polygonal shapes.

Figure 10E:
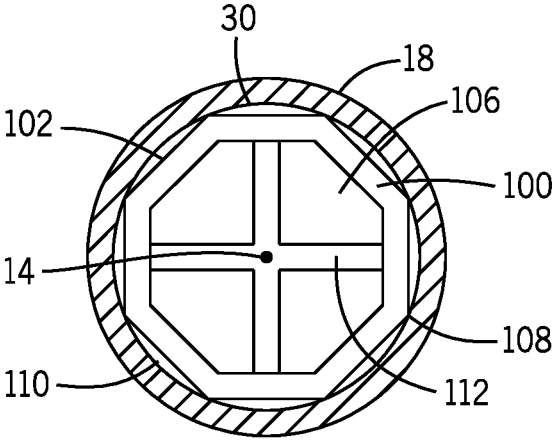
FIG. 10E is a cross-sectional view of a polygonal shaped stiffening element and a barrel portion of a bat in accordance with another example implementation of the present invention.

Referring to FIG. 10E, the stiffening element 100 may have an outer surface 102 that defines a polygonal shape such as an octagon. In other implementations, the stiffening element 100 can have outer shapes that are triangular, square, pentagonal, hexagonal, or other polygonal shapes. The polygonal shaped stiffening element 100 engages the inner surface 30 of the barrel portion 18 at points or lines of contact 108. For example, the stiffening element of FIG. 10E has eight lines of engagement or contact 108 with the inner surface 30 of the barrel portion 18. The polygonal shaped stiffening element 100 forms a plurality of gaps 110 between the outer surface 102 of the stiffening element 100 between the lines of engagement 108 and the inner surface 30 of the barrel portion 18. The size and number of the gaps 110 can be varied based upon a particular application. The stiffening element 100 of FIG. 10E also includes cross-members 112 that extend through the opening 106. The cross-members 112 can cause the opening 106 to be a plurality of openings 106. The cross-members 112 can intersect the center of the stiffening element 100 and the longitudinal axis 14 of the bat, and can intersect each other. The cross-members 112 of FIG. 10E intersect each other to form four separate openings 106 and four legs extending from the center of the stiffening element 100. The cross-members 112 can have a thickness or width that matches the width or thickness of the outer surface 102 of the stiffening element 100. In other implementations, the cross-members 112 can have a thickness that is less than the thickness of the outer surface 102. In other implementations, the cross-member 112 can take other shapes, forms, numbers, and/or sizes. The cross-members 112 may form 2 or more openings 106 within the stiffening member 100, may or may not intersect the center or longitudinal axis 14. The cross-members 112 can be used to increase the stiffness of the stiffening element 100. In other implementations, the cross-members can be form any shape that defines 2 or more openings within the stiffening element.

Figure 11A:
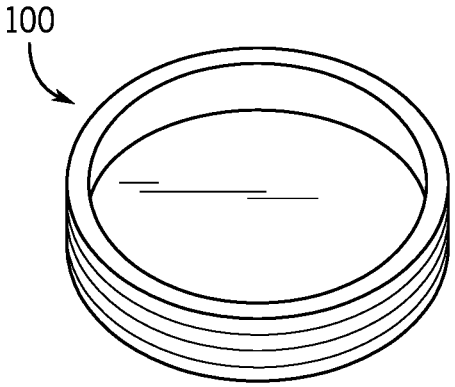
FIG. 11A is a top, side perspective view of a disc stiffening element in accordance with an example implementation of the present invention.
Figure 11B:
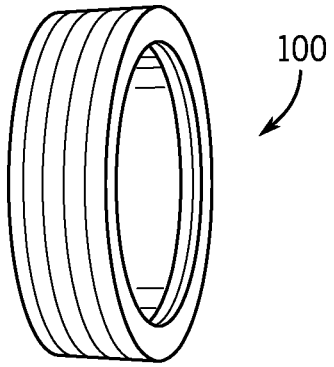
FIG. 11B is a side perspective view of a disc stiffening element in accordance with another example implementation of the present invention.
Figure 11C:
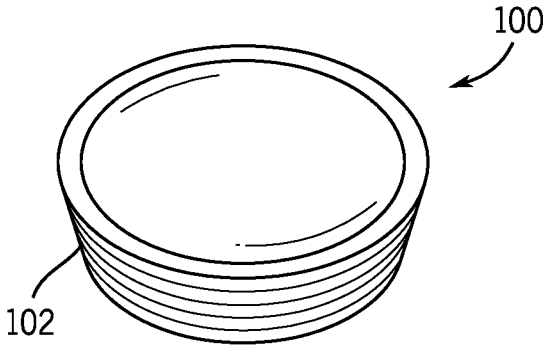
FIG. 11C is a top, side perspective view of a disc stiffening element in accordance with another example implementation of the present invention.

Referring to FIGS. 11A through 11F, in other implementations the stiffening element 100 can have a generally disk shape. The shape and construction of the disk shape can vary. In the implementation of FIG. 11A, the stiffening element 100 has a cup like shape or a petri-dish type shape. Referring to FIGS. 11B and 11C, in other implementations, the stiffening element 100 can have a disk shape that resembles a puck or slug, in which the stiffening element 100 has a substantially solid circular shape. The stiffening element 100 can vary in shape, color or construction. For example, in FIG. 11B, the stiffening element is formed of a polycarbonate material. In the implementation of FIG. 11C, the stiffening element can be include fiber reinforcement with a polycarbonate material or other polymeric material.

Figure 11D:
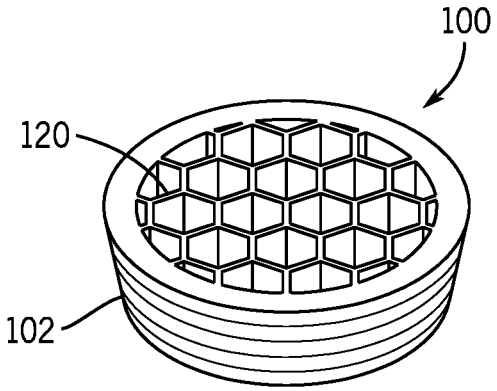
FIGS. 11D through 11F are top, side perspective views of disc stiffening elements in accordance with other example implementations of the present invention.
Figure 11E:
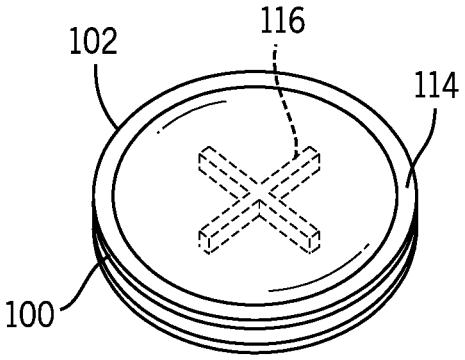
Figure 11F:
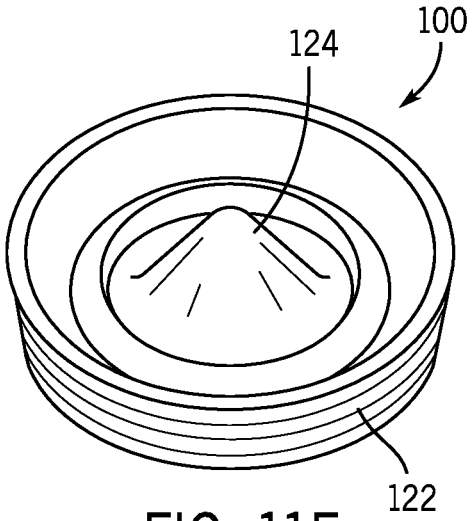

Referring to FIG. 11D, in one implementation, the stiffening element 100 takes the form of a honeycomb disk with a honeycomb structure 120 positioned on either side of a cross disk. Referring to FIG. 11E, the stiffening element 100 can be a pair of circular discs 114 separated by one or more spacing elements 116. Referring to FIG. 11F, the stiffening element 100 can be formed of two or more separate materials such as an aluminum outer portion 122 and a polymeric inner portion 124. The outer portion 122 can be an annular member with a cross-sectional shape similar to the above-described annular members, and the inner portion 124 can have a conical shape for facilitating some compression of the stiffening element 100. The shape, size and material construction of the inner and outer portions 124 and 122 can be varied to match a particular application or desired stiffness value.

Figure 12:
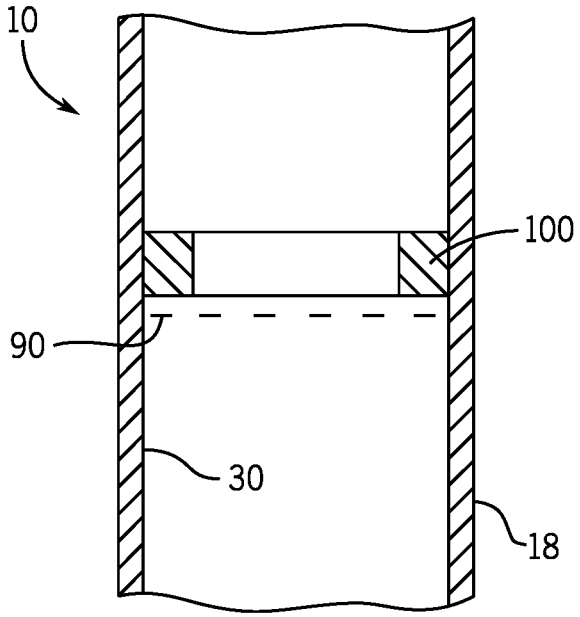
FIG. 12 is a longitudinal cross-sectional view of a portion of a bat barrel including an annular stiffening element in accordance with an example implementation of the present invention.
Figure 13A:
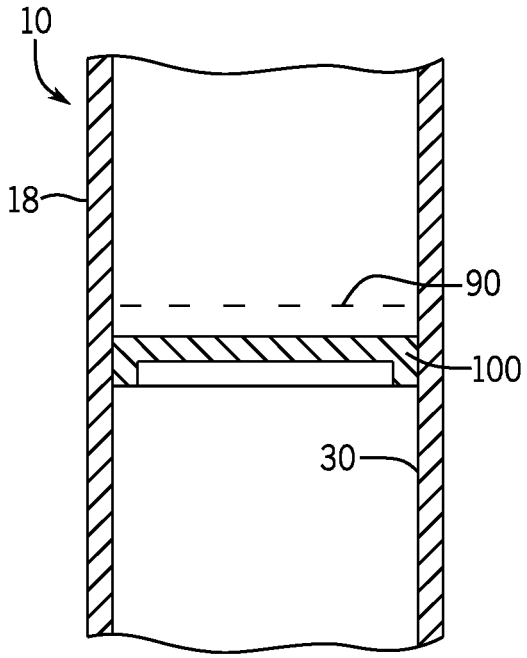
FIGS. 13A and 13B are longitudinal cross-sectional views of portions of bat barrels including disc stiffening elements in accordance with other example implementations of the present invention.

FIGS. 12 and 13A illustrate other example implementations of the present invention in which the stiffening element 100 is shown positioned on either side of the ABI fuse region 90 within the barrel portion 18 of the bat 10 or 200. As shown in FIGS. 12 and 13, the ABI fuse region 90 can be positioned on either side of the stiffening element 100 depending on a particular application or desired failure location. In FIGS. 12 and 13A, the ABI fuse region 90 is shown longitudinally spaced apart from the stiffening element 100. In one implementation, the ABI fuse region 90 can be longitudinally positioned with respect to the stiffening element 100 so as to within the range of 0 to 1.0 inch. In one example implementation, the ABI fuse region 90 can be longitudinally positioned so as to overlie one of the edges of the stiffening element 100. In another example implementation, the ABI fuse region 90 can be longitudinally spaced apart from the stiffening element 100 by up to 1 inch. In another implementation, the ABI fuse region 90 can be longitudinally positioned with respect to the stiffening element 100 so as to within the range of 0.1 to 0.75 inch.

Figure 13B:
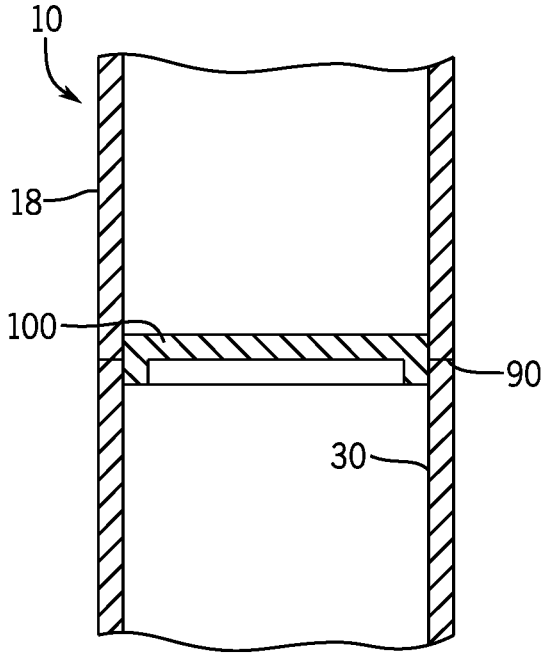

FIG. 13B illustrates another example implementation of the present invention in which the ABI fuse region 90 within the barrel portion 18 of the bat 10 or 200 overlies, or is positioned at the same longitudinal location along the barrel portion 18, as the stiffening element 100. In FIG. 13B, the ABI fuse region 90 is shown positioned near the center of the stiffening element 100. However, the ABI fuse region 90 can also be positioned at any location that overlies or is in the same longitudinal location along the barrel portion as the stiffening element 100.

Figure 14A:
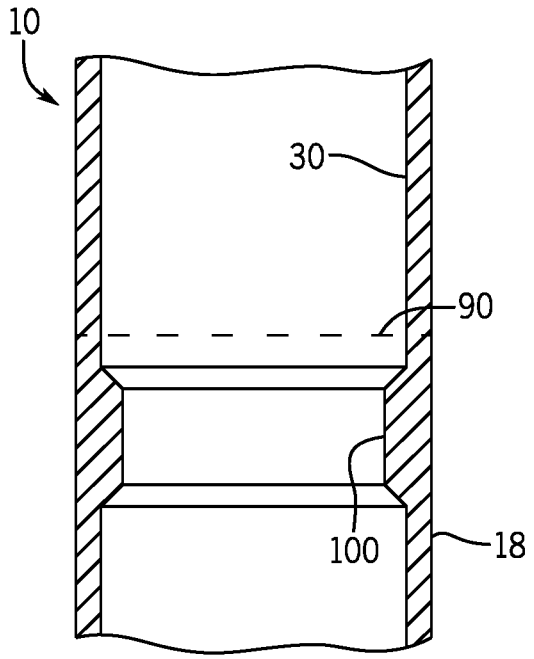
FIGS. 14A and B are longitudinal cross-sectional views of portions of bat barrels including disc stiffening elements in accordance with other example implementations of the present invention.

Referring to FIG. 14A, in another implementation, the stiffening element 100 can be formed by creating a region of increased thickness in the composite lay-up of the bat barrel portion 18. The region of increased thickness increases the stiffness of the barrel portion 18 at that location thereby forming a stiffening element. The stiffening element 100 of FIG. 14A is integrally formed with the barrel portion 18 of the bat 10. The stiffening element 100 can be formed as part of the original lay-up of the barrel portion 18 formed of fiber composite material or added during or after the lay-up of the barrel portion 18 as part of a co-molding or secondary molding process. As shown in FIG. 14A, the ABI fuse region 90 can be positioned on either side of the stiffening element 100 depending on a particular application or desired failure location. FIG. 14A illustrates the ABI fuse region positioned in the bat barrel 18 to be on the end cap side of the stiffening element 100. However, the ABI fuse region 90 can also be placed on the handle side (or opposite side) of the stiffening element 100.

Figure 14B:
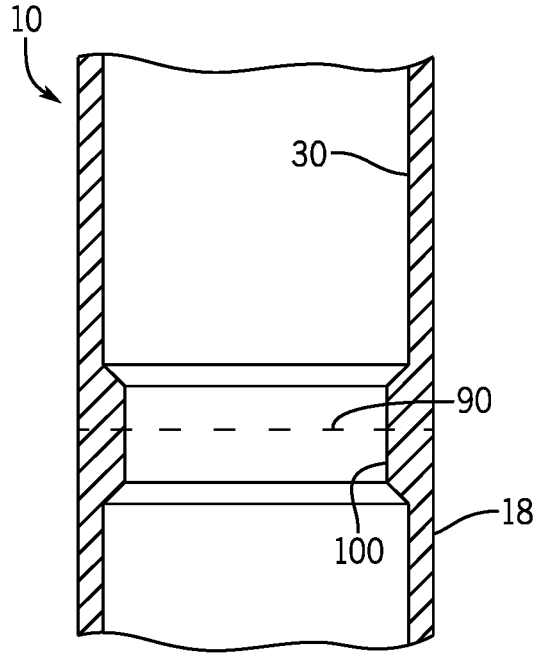

FIG. 14B illustrates another example implementation of the present invention in which the ABI fuse region 90 within the barrel portion 18 of the bat 10 or 200 is positioned at the same longitudinal location along the barrel portion 18, as the stiffening element 100, wherein the stiffening element is formed by creating a region of increased thickness in the composite lay-up of the bat barrel portion 18. In FIG. 14B, the ABI fuse region 90 is shown positioned on the barrel portion 18 at a longitudinal location near the center of the stiffening element 100 (the center of the region of increased wall thickness of the barrel portion 19). However, the ABI fuse region 90 can also be positioned at any location that is within the region of increased wall thickness along the barrel portion 18.

Referring to FIG. 9, in one implementation, the bat 200 may include an ABI fuse region 90*b* positioned adjacent the endcap 38 of the bat 20. The endcap 38 can serve to increase the stiffness of the distal end of the barrel portion 18. In such a construction, the bat 200 may be formed with or without a stiffening element 100. The endcap 38 essentially provides a similar function as that of the stiffening element by creating a sudden change in barrel stiffness that can force a failure or catastrophic failure of the bat barrel portion 18 during the bat rolling procedure of the ABI break-in test at the ABI fuse region 90*b*.

Figure 15:
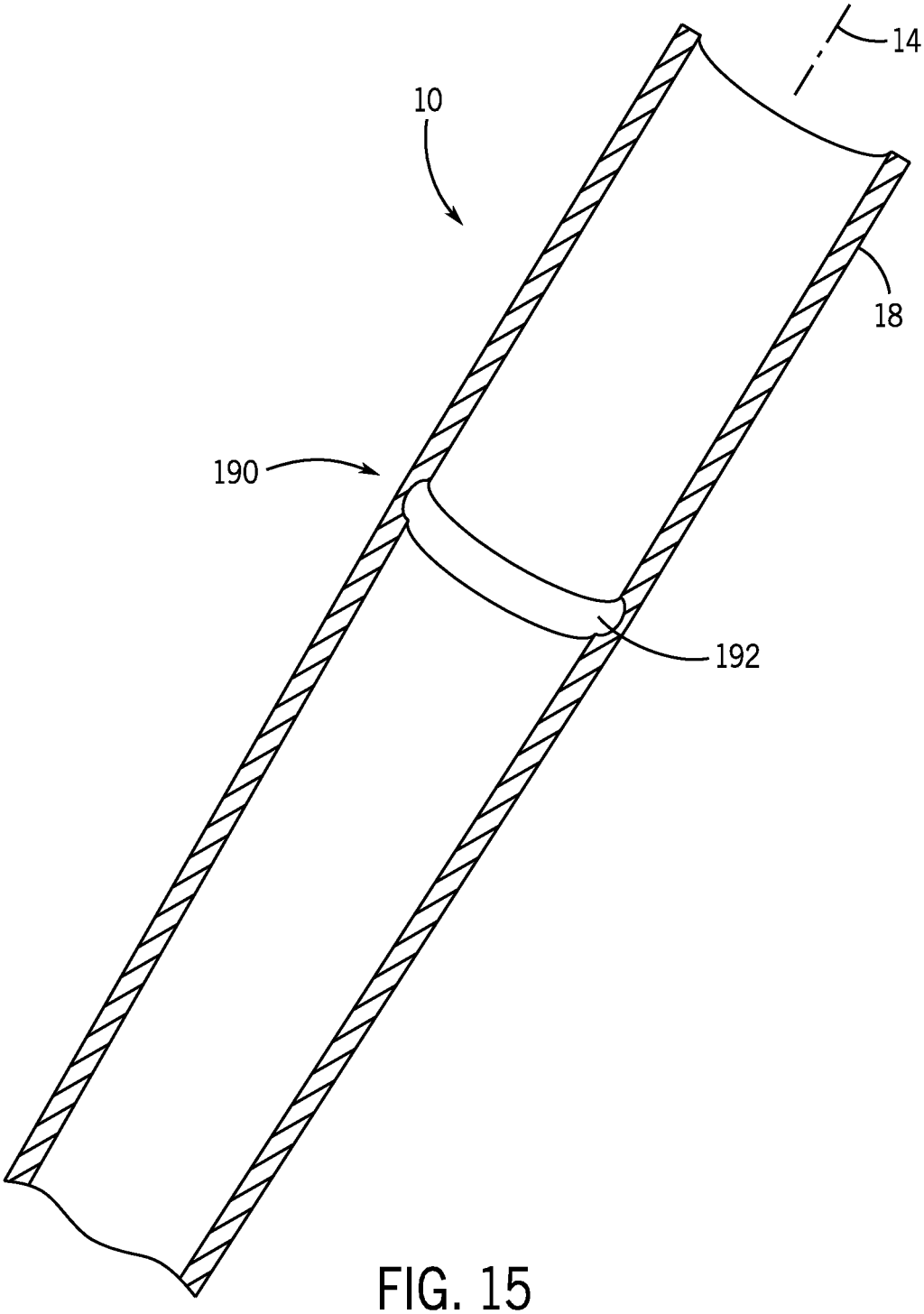
FIG. 15 is a longitudinal cross-sectional view of a barrel portion of a bat including an example ABI fuse region in accordance with an example implementation of the present invention.

Referring to FIG. 15, in another implementation of the present invention, an ABI fuse region 190 can be formed by adding a groove 192 within the inner surface 30 of the barrel portion 18 formed of a fiber composite material. In one implementation, the groove 192 is machined into the inner surface 30 of the barrel portion 18 after the barrel portion 18 has been laid-up and fully cured. In other implementations, the groove can be formed into the other inner surface of the barrel portion through other means such as molding. The groove 192 can be a single continuous annular groove extending completely about the inner circumference of the barrel portion 18. The groove 192 is orientated so as to be generally perpendicular to the longitudinal axis 14. In other words, the groove 192 can extend about a groove plane 198 that is perpendicular to the longitudinal axis 14. The groove 192 can have a depth within the range of 5 to 75 percent of the wall thickness of the barrel portion 18 at the general location of the groove 192. In other implementations, the groove 192 can have a depth within the range of 10 to 50 percent of the wall thickness 18 of the barrel portion.

The groove 192 creates a fuse or a discontinuity in the barrel portion 18 that forms the ABI fuse region 190. The groove 192 can have a semi-circular shape. In other implementations, the groove can have other shapes such as for example, semi-ovular, triangular, rectangular, other polygonal shapes and other curved shapes. When the bat 10 with the ABI fuse region 190 is subjected to an ABI break-in test including a bat rolling procedure, the discontinuity caused by the groove 192 can result in the bat barrel portion 18 failing or catastrophically failing during the bat rolling procedure of the ABI break-in test.

In one implementation, the ABI fuse region 190 can be spaced apart from the end cap 38 at the distal end of the barrel portion 18 by a distance within the range of 1.0 to 4.0 inches. In another implementation, the ABI fuse region 190 can be spaced apart from the end cap 38 at the distal end of the barrel portion 18 by a distance within the range of 7.0 to 12.0 inches.

Figure 16:
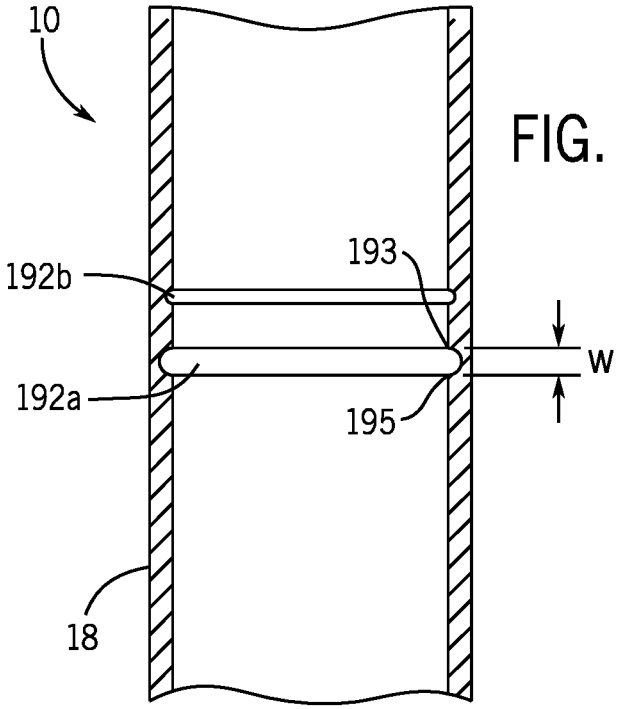
FIG. 16 is a longitudinal cross-sectional view of a portion of a bat barrel including an ABI fuse region in accordance with another example implementation of the present invention.
Figure 17:
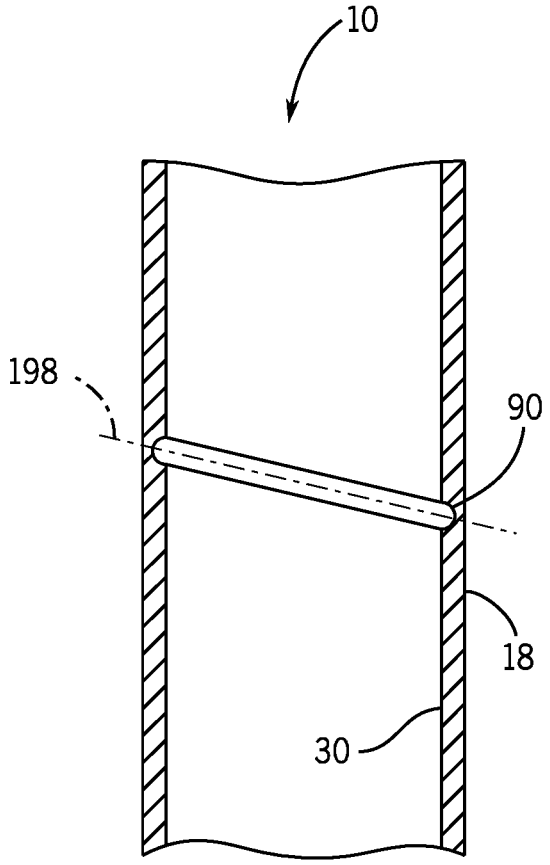
FIGS. 17 through 21B are longitudinal cross-sectional views of portions of bat barrels including ABI fuse regions in accordance with other example implementations of the present invention.
Figure 18:
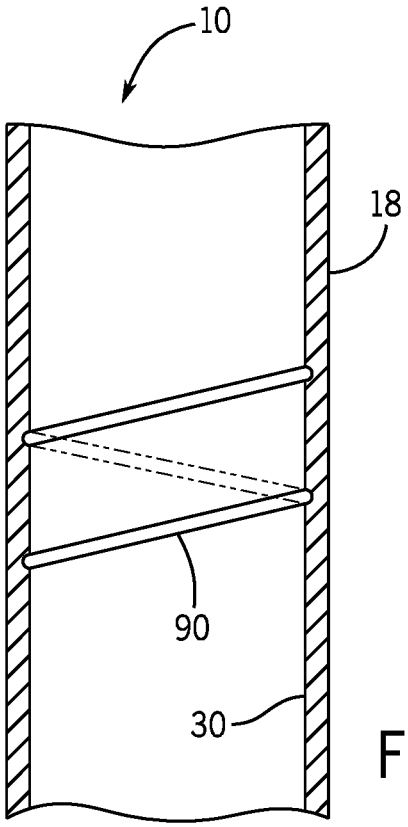

Referring to FIGS. 16 through 18, the ABI fuse region 190 can take a variety of different forms. In the implementation of FIG. 16, the ABI fuse region 190 is formed by two longitudinally spaced apart grooves 192*a* and 192*b*. The grooves 192*a* and 192*b* can be formed in different lengths and/or widths. The grooves, such as groove 192*a*, include first and second side edges 193 and 195 defined by the transition of the groove to the barrel portion 18. The grooves, such as groove 192*a* have a width, w, within the range of 0.25 to 4.0 inches, when measured from the first side edge 193 to the second side edge 195. In one implementation, the width w of the groove, such as the groove 192*a*, can be within the range of 0.025 to 0.5 inch. The grooves 192*a* and 192*b* can be longitudinally spaced apart from each other by a distance within the range of 0.25 to 10.0 inches. In another implementation, the grooves 192*a* and 192*b* can have the same width and/or depth. In other implementations, the number of grooves 192 formed in the barrel portion 18 can be 3 or more.

Referring to FIG. 17, in another implementation, the groove 192 can be angled such that the groove 192 extends about a groove plane 198 that is angled with respect to the longitudinal axis 14 within the range of 45 to 89 degrees. Referring to FIG. 18, in another implementation, the ABI fuse region 190 can be formed by a spiral groove 190 formed within the inner surface 30 of the barrel portion 18. The spiral groove 190 can be angled with respect to the longitudinal axis 14 of the bat 10 such that the spiral groove 190 extends about the entire circumference of the barrel portion 18 within a longitudinal distance of 13 inches or less when measured with respect to the longitudinal axis 14. In other implementations, the spiral groove 190 can be angled such that the longitudinal distance required for the spiral groove to extend about the circumference of the barrel portion 18 is 7 inches or less. In another implementation, the spiral groove 190 may extend about the barrel portion 18 in a manner such that the spiral groove 190 extends over less than a full circumference of the barrel portion 18. In other implementations, other orientations, sizes, numbers and shapes of grooves can be used to form the ABI fuse region.

Figure 19:
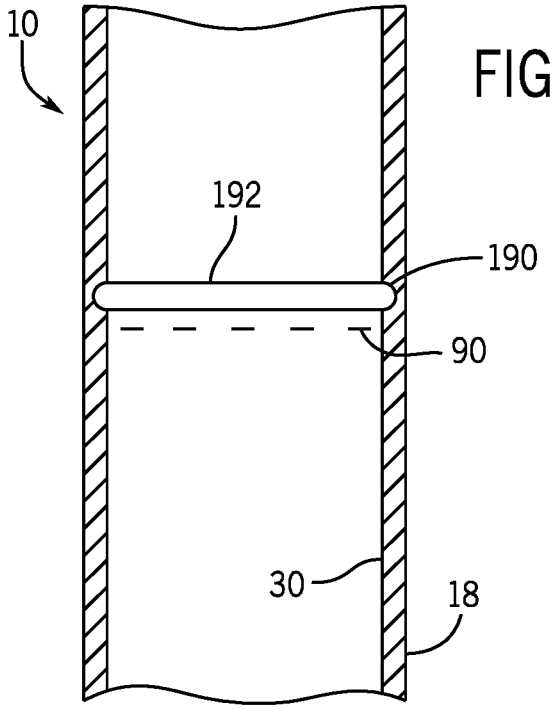

Referring to FIG. 19, in one implementation, the ABI fuse region 190 can be formed adjacent to the ABI fuse region 90. The ABI fuse region 190 can be longitudinally spaced part from the ABI fuse region 90 by a distance of at least 0.25 inch.

Figure 20A:
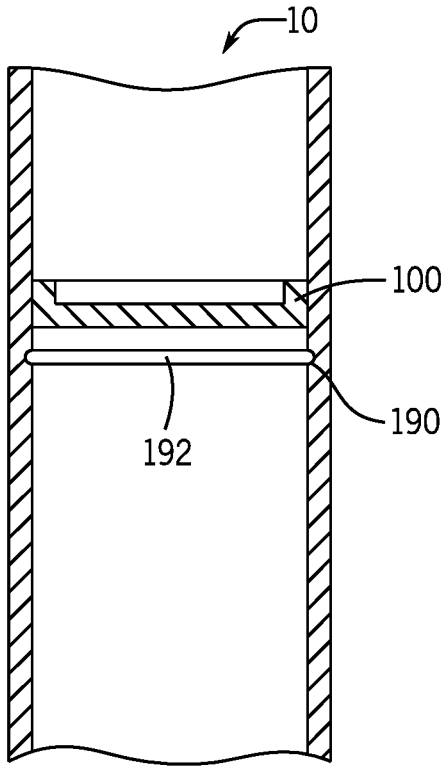
Figure 21A:
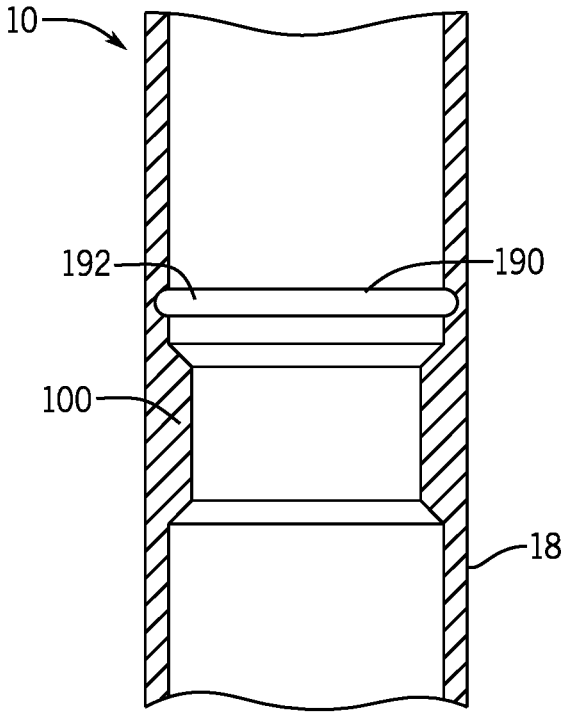
Figure 21B:
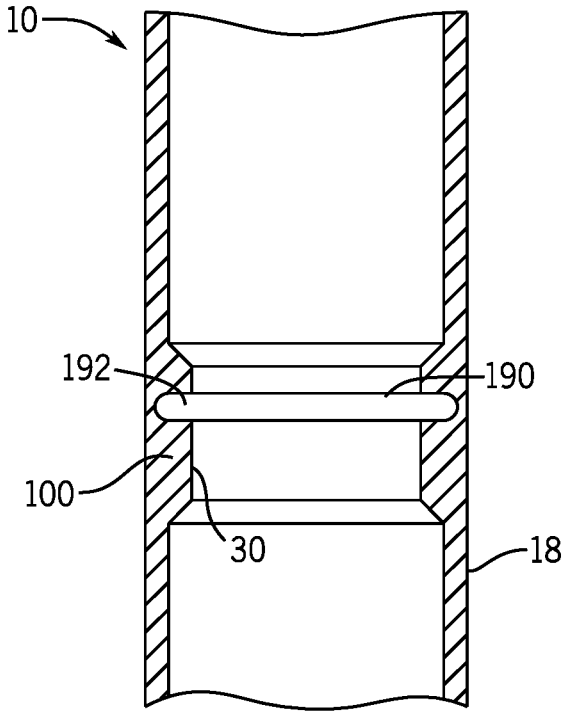

Referring to FIGS. 20A and 21B, in other implementations the ABI fuse region 190 can be positioned adjacent the stiffening element 100. The groove 192 can be positioned on either side of the stiffening element 100 within the bat barrel 18. In FIG. 20A, the stiffening 100 is a disc inserted within the barrel portion 18, and in FIG. 21A, the stiffening element 100 is formed by a region of increased wall thickness of the barrel portion 18 of the bat 10.

Figure 20B:
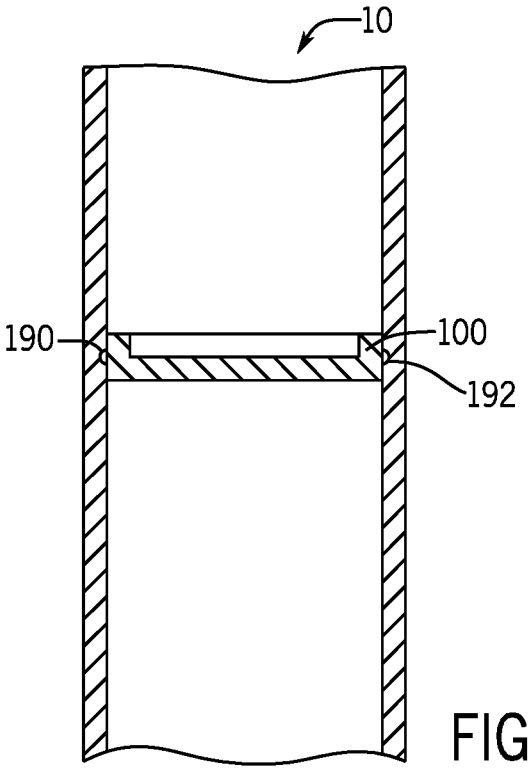

Referring to FIGS. 20B and 21B, in other implementations the ABI fuse region 190 can be positioned or located to be at substantially the same longitudinal location about the barrel portion 18 as the stiffening element 100. In FIG. 20B, the stiffening 100 is a disc inserted within the barrel portion 18, and in FIG. 21B, the stiffening element 100 is formed by a region of increased wall thickness of the barrel portion 18 of the bat 10. The ABI fuse region 190 can be formed by placing the groove 190 at any longitudinal location along the barrel portion 18 that is aligned with the stiffening element 100. In one implementation, the ABI fuse region 190 can be positioned longitudinally along the barrel portion 18 such that it overlies the stiffening element 100.

The bat 10, 200 of the present invention provides numerous advantages over existing ball bats. One such advantage is that the bat 10, 200 of the present invention is configured for competitive, organized baseball or softball. For example, embodiments of ball bats built in accordance with the present invention can fully meet the bat standards and/or requirements of one or more of the following baseball and softball organizations: ASA Bat Testing and Certification Program Requirements; United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol.

Accordingly, the term "bat configured for organized, competitive play" refers to a bat that fully meets the ball bat standards and/or requirements of, and is fully functional for play in, one or more of the above listed organizations.

The present invention provides a method and system for forming barrel portions of a ball bat or other cylindrical portions of a ball bat using fiber composite material that can satisfy ball bat equipment standards and/or requirements in a cost effective, reliable and high quality manner. The present invention provides a method and system for forming barrel portions of a ball bat or other cylindrical portions of a ball bat using fiber composite material that provides a high quality cosmetic appearance, is highly durable, and provides the desired operational characteristics. The present invention provides a method and system for forming barrel portions of a ball bat or other cylindrical portions of a ball bat using fiber composite material that can satisfy performance requirements, such as BBCOR certification or the USABat standard, without adding too much weight or wall thickness to the barrel portion. The present invention also provides a ball bat with a desirable level of barrel stiffness, exceptional feel and performance.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically defined in this specification, the terminology used in the present specification is intended to be interpreted in its broadest reasonable manner, even though may be used conjunction with the description of certain specific embodiments of the present invention.

What is claimed is:

1. A ball bat extending along a longitudinal axis and configured for testing under an accelerated break-in test, the bat configured for organized, competitive play, the bat comprising:

a barrel portion including an inner surface and being formed of a fiber composite material having a generally uniform wall thickness of at least 0.060 inch, the fiber composite material including at least first and second plies, the first ply including a first plurality of fibers aligned adjacent to one another and a first resin, and the second ply including a second plurality of fibers aligned adjacent to one another and a second resin, the inner surface of the barrel portion defining at least one annular groove, the at least one annular groove creating an ABI fuse region of the barrel portion, the barrel portion at the location of the at least one groove being thinner than the generally uniform wall thickness, the at least one annular groove being visible from the inner surface of the barrel portion and uncovered, the ABI fuse region forming a crack initiation location when the bat is subjected to the accelerated break-in test; and a separate stiffening element positioned within the barrel portion, and the stiffening element positioned adjacent the ABI fuse region.

2. The ball bat of claim 1, wherein the at least one annular groove is at least a first annular groove and a second annular groove, and wherein the first and second annular grooves are longitudinally spaced apart from each other.

3. The ball bat of claim 1, wherein the at least one annular groove is a single continuous groove, and wherein the at least one annular groove has a depth within the range of 5 to 75 percent of the wall thickness of the barrel portion.

4. The ball bat of claim 3, wherein the at least one annular groove has first and second side edges, and wherein the groove has a width within the range of 0.025 to 4.0 inches when measured from the first side edge to the second side edge.

5. The ball bat of claim 4, wherein the depth of the groove is within the range of 20 to 60 percent of the wall thickness of the barrel portion, and wherein the width of the groove is within the range of 0.025 to 0.5 inch.

6. The ball bat of claim 1, wherein the at least one annular groove extends about at least one groove plane, and wherein the at least one groove plane is angled with respect to the longitudinal axis by an angular amount within a range of 45 to 90 degrees.

7. The ball bat of claim 6, wherein the at least one groove plane is substantially perpendicular to the longitudinal axis.

8. The ball bat of claim 1, wherein the at least one groove forms at least one spiral groove, and wherein the at least one spiral groove extends about the inner surface of the barrel by an amount less than 720 degrees with respect to the longitudinal axis.

9. The ball bat of claim 1, wherein the stiffening element is an annular member.

10. The ball bat of claim 1, wherein the stiffening element is a circular disk.

11. The ball bat of claim 10, wherein the stiffening element is longitudinally spaced apart from the ABI fuse region by at least 0.25 inch.

12. The ball bat of claim 10, wherein the stiffening element is formed of a rigid material selected from the group consisting of aluminum, polycarbonate, polyurethane, titanium, other metals, other polymeric materials and combinations thereof.

13. The ball bat of claim 1, further comprising an end cap coupled to a distal end of the barrel portion, and wherein the ABI fuse region is longitudinally spaced apart from the end cap by a distance within the range of 1.0 to 4.0 inches.

14. The ball bat of claim 1, further comprising an end cap coupled to a distal end of the barrel portion, and wherein the ABI fuse region is longitudinally spaced apart from the end cap by a distance within the range of 7.0 to 12.0 inches.

15. The ball bat of claim 1, wherein the barrel portion includes first and second barrel regions positioned adjacent to the ABI fuse region on proximal and distal sides of the ABI fuse region, the first ply includes a first proximal ply portion and a first distal ply portion, and wherein the ABI fuse region includes a first fiber discontinuity that separates the first proximal ply portion from the first distal ply portion.

16. The ball bat of claim 1, wherein the first ply includes a first proximal ply portion and a first distal ply portion, and wherein the first proximal ply portion is longitudinally spaced apart from the first distal ply portion to form a first fiber discontinuity.

17. The ball bat of claim 16, wherein the barrel portion is formed entirely of the fiber composite material and the fiber composite material forms a single unitary tubular structure, wherein the first plurality of fibers of the first proximal ply portion are generally aligned to define a first proximal angle with respect to the longitudinal axis, wherein the first plurality of fibers of the first distal ply portion are generally aligned to define a first distal angle with respect to the longitudinal axis, and wherein the first proximal angle and the first distal angle vary by at least 10 degrees.

18. The ball bat of claim 17, wherein the first proximal angle and the first distal angle vary by at least 30 degrees.

19. The ball bat of claim 1, wherein the inner surface of the barrel portion is not tampered with by a bat doctor.

20. The ball bat of claim 1, wherein the bat includes a knob, and wherein the stiffening element is longitudinally positioned between the at least one annular groove and the knob.

21. The ball bat of claim 1, wherein the bat includes an end cap, and wherein the stiffening element is longitudinally positioned between the at least one annular groove and the end cap.

* * * * *